US010647457B2

(12) United States Patent
Hutter et al.

(10) Patent No.: US 10,647,457 B2
(45) Date of Patent: May 12, 2020

(54) FOLDING DEVICE, PACKAGING FACILITY FOR ARTICLES, AND METHOD FOR FOLDING SIDE FLAPS OF EXTERNAL CARDBOARD PACKAGINGS

(71) Applicant: KRONES Aktiengesellschaft, Neutraubling (DE)

(72) Inventors: Alban Hutter, Reit im Winkel (DE); Christian Canalicchio, Bad Endorf (DE); Martin Dietersberger, Grosskarolinenfeld (DE); Wolfgang Fechter, Rosenheim (DE); Thomas Stadler, Kolbermoor (DE); Andreas Triffo, Feldkirchen (DE)

(73) Assignee: Krones Aktiengesellschaft, Neutraubling (DE)

( * ) Notice: Subject to any disclaimer, the term of this patent is extended or adjusted under 35 U.S.C. 154(b) by 182 days.

(21) Appl. No.: 15/866,864

(22) Filed: Jan. 10, 2018

(65) Prior Publication Data

US 2018/0222608 A1 Aug. 9, 2018

(30) Foreign Application Priority Data

Feb. 6, 2017 (DE) ..... 10 2017 201 830

(51) Int. Cl.
*B65B 7/20* (2006.01)
*B65B 43/52* (2006.01)
(Continued)

(52) U.S. Cl.
CPC ..... *B65B 7/20* (2013.01); *B65B 5/024* (2013.01); *B65B 11/004* (2013.01); *B65B 11/12* (2013.01); *B65B 43/52* (2013.01); *B65B 51/067* (2013.01)

(58) Field of Classification Search
CPC ..... B65B 7/20; B65B 43/265; B65B 43/52; B65B 49/14; B65B 65/02; B65B 5/024;
(Continued)

(56) References Cited

U.S. PATENT DOCUMENTS 749,681 A * 1/1904 Beardsley ..... B31B 50/00 53/377.2
2,358,292 A * 9/1944 Malhiot ..... B65B 43/52 198/803.11
2,900,778 A * 8/1959 Hartbauer ..... B65B 7/22 53/377.2
4,569,182 A 2/1986 Leuvering
(Continued)

FOREIGN PATENT DOCUMENTS

DE 3307855 A1 * 9/1984 ..... B65B 11/004
DE 202005014345 U1 * 1/2007 ..... B65B 7/20
(Continued)

OTHER PUBLICATIONS

German Patent Application DE 10 2017 201 830.5—German Search Report dated Jan. 6, 2018.

*Primary Examiner* — Stephen F. Gerrity
(74) *Attorney, Agent, or Firm* — Simmons Perrine Moyer Bergman PLC

(57) ABSTRACT

The invention relates to a folding device (10) for transporting an outer cardboard package (20) having folding lines and for folding at least one side flap (21) of the outer cardboard package (20). The folding device (10) comprises at least one conveyor system with a guiding unit (11) and with at least two transporting and folding shuttles (30) disposed on the guiding unit (11) for the transport of the outer cardboard packages (20) in a transport direction (TR). The at least two shuttles (30) are disposed in a row at the conveyor system and are transported in a transport direction (TR) through and/or by the conveyor system. Each shuttle (30) comprises its own, individually controllable drive (32) and further at
(Continued)

least one folding unit (35) for folding over at least one side flap (21) of an outer cardboard package (20).

16 Claims, 8 Drawing Sheets

(51) Int. Cl.

| | |
|---|---|
| ***B65B 51/06*** | (2006.01) |
| ***B65B 5/02*** | (2006.01) |
| ***B65B 11/12*** | (2006.01) |
| ***B65B 11/00*** | (2006.01) |

(58) Field of Classification Search
CPC ..... B65B 11/004; B65B 11/12; B65G 54/02; B31B 50/0042
USPC ..... 53/458, 467, 491, 566, 579, 284, 376.4, 53/377.2, 378.3
See application file for complete search history.

(56) References Cited

U.S. PATENT DOCUMENTS

| | | | | |
|---|---|---|---|---|
| 5,282,530 | A * | 2/1994 | Neri | B65B 59/005 198/803.11 |
| 6,038,831 | A | 3/2000 | Nava | |
| 9,493,260 | B2 | 11/2016 | Koch et al. | |
| 2014/0352261 | A1* | 12/2014 | Bellante | B65B 7/16 53/458 |
| 2016/0176659 | A1* | 6/2016 | Aumann et al. | B65G 54/02 198/619 |
| 2016/0207658 | A1* | 7/2016 | Bellante | B65B 43/52 |
| 2017/0341875 | A1* | 11/2017 | Baechle | B65G 54/02 |

FOREIGN PATENT DOCUMENTS

| | | | | |
|---|---|---|---|---|
| DE | 202005014345 | U1 | 1/2007 | |
| DE | 102014226494 | | 6/2016 | |
| DE | 102015107630 | A1 * | 11/2016 | B31B 50/00 |
| DE | 102015107630 | A1 | 11/2016 | |

* cited by examiner 35,37
42,63
31
35,36
42,53
34,61,64
30,60
30,50
34,51,54
30

35,37
31
34,61,64
42,53
42,63
d
35,36
30,60
30,50
34,51,54
30

10, AZ1

TR
30,30-1
30,30-3
30,30-2
11,12
40

TR
T1
T2
T3
30,30-1
30,30-3
30,30-2
11,12
10, AZ1

FOLDING DEVICE, PACKAGING FACILITY FOR ARTICLES, AND METHOD FOR FOLDING SIDE FLAPS OF EXTERNAL CARDBOARD PACKAGINGS

CLAIM OF PRIORITY

The present application claims priority to German Application DE 10 2017 201 830.5, filed Feb. 6, 2017, which is incorporate by reference.

FIELD OF THE INVENTION

The present invention relates to a folding device for transporting an outer cardboard package having folding lines and for folding at least one side flap of the outer cardboard package. The invention furthermore relates to a packaging facility for articles to be packaged, the packaging facility comprising an outer packaging module for producing an outer package, and to a method for folding at least one side flap of an outer cardboard package having folding lines.

BACKGROUND OF THE INVENTION

Generally, box blanks with die-cut folding lines are used in the production of external cardboard packages such as so-called baskets, trays, etc. In order to form the external package, the bottom flap/s, the top flap/s, and the side flaps are folded in or folded up, or the like, along the folding lines in a specified sequence and, if required, are secured to the box surfaces located therebeneath by means of adhesive points or the like.

This also relates to the production of a so-called RSC box, for example, which is to be understood as a type of outer packages that are produced from suitable box blanks. The acronym "RSC" in this context stands for "regular slotted carton". This is a common box structure with four flaps or bottom flaps at the bottom box opening and four flaps or top flaps at the top box opening. For a rectangular cardboard box, the shorter sided bottom flaps or, as the case may be, the shorter sided top flaps, are normally the smaller flaps, which are, in particular, arranged inside the box. The longer sided lengthwise bottom flaps or, as the case may be, the longer sided top flaps defining the box length are referred to as major flaps. The major flaps usually meet at the center of the box, where they can be glued together, for example, with a plastic or water-activated tape.

The box blank is first folded to form the box structure with the top and bottom box openings in each case open, and an overlapping side flap is glued, thereby forming a cuboid that is open on both sides. Then the smaller inside bottom flaps with the shorter sides are folded inward until they are arranged substantially perpendicular to the already connected sidewall. Usually, an adhesive or the like is applied onto the outer surfaces of the correspondingly folded smaller inside bottom flaps. Afterwards, the larger outside bottom flaps, or, more precisely, the major flaps, are folded toward the smaller inside bottom flaps and pressed against them such that the larger outside bottom flaps, or, more precisely, the major flaps, are adhesively connected to the smaller inside bottom flaps.

For certain applications it may be advantageous to rotate the expanded RSC box by 90 degrees or to lay it down flat prior to closing the bottom and top openings such that the two openings are then laterally disposed.

Flaps also have to be closed in the production of other outer packages, such as in the production of so-called side-load boxes, end-load boxes, cartons with only one top flap and/or bottom flap that can in each case substantially cover the entire top opening or bottom opening, respectively, etc.

For closing laterally arranged bottom flaps or top flaps, devices are known, for example, in which the flaps are folded in by stationary folding-in units or folding units, also referred to as so-called folding members, and the flaps are held in this folded-in position, or, more precisely, closed position, by a rail. In particular, outer cardboard packages that are open on one side are transported past the corresponding folding-in unit or folding unit or folding member for this purpose. Closing tools with shutters, levers, or fingers, or the like may moreover be employed in cycle operation.

A packaging machine for wrapping an article group, for example consisting of bottles, into a box blank having folding lines is known from EP 1 471 006 B1, for example. This known packaging machine has a bundle-forming unit, which first places the four side surfaces of the box blank circumferentially around the article group standing on the box blank. The side flaps, which are aligned lengthwise to a conveying direction of the bundle group and the box blanks, are then folded in at right angles with the conveyor track, just like subsequently the bottom flaps and/or top flaps are. The side flap closers, which are clearly discernible in the FIGS. 24 to 26 of EP 1 471 006 B1, are provided for this purpose. These side flap closers are two disk-like elements made of half-sickle shapes arranged at both sides of the package conveyor at about the same height in relation to the conveying direction, which elements rotate in a plane that is parallel to the conveying plane, with the elements being coupled to the drive motor for the package conveyor by means of mechanical drive units in order to allow precision-adjusted synchronization of the rotary movement in relation to the feed movement of the packages. These elements are designed to fold in both the preceding and the succeeding side flaps at the front or back ends of the particular passing outer cardboard packages by an angle of approximately 90 degrees. In order to be able to handle boxes of different-sized formats on one machine, the half sickle-shaped disk-like side flap closers are designed to have two parts, where both parts can be manually twisted relative to each other for the purpose of format adaptation.

Furthermore, DE 20 2005 014 345 U1 discloses an apparatus for packaging articles in a box blank having folding lines with side flaps, top flaps and/or bottom flaps, with a device for feeding an article stream; a device for dividing article groups; a device for feeding individual box blanks in conveying direction of the article groups, with the box blanks being transported in a consecutive row from below to be placed underneath the article groups, and the side flaps running pointing lengthwise to the conveying direction; and a device for forming an external cardboard package as well as for folding in the side flaps transversely to the conveying direction by means of folding-in units rotating about an axis that is perpendicular to the conveying plane of the box blanks. The folding-in units are designed as rod-shaped fingers and in each case aligned pairwise at right angles with the perpendicular axis, and they are arranged at approximately right angles, offset in relation to each other in circulation direction, with one finger folding in the side flap located at the rear end of the preceding external cardboard package and the second finger folding in the side flap located at the front-facing end of the succeeding external cardboard package.

The patent application publications DE 10 2010 015 865 A1 and DE 10 2015 107 630 A1 each describe a device and a method for packaging articles in a box blank having folding lines with side flaps and/or top flaps and/or bottom flaps, with the device likewise having folding members for folding over or folding in the side flaps.

For cycle operation with a plurality of external cardboard packages being conveyed from station to station, it would be necessary to dispose stationary folding members between the stations. In cycle operation, however, the transport speed is usually greatest between the individual stations. Additionally, folding in the side flaps in this intermediate area would thus require extreme speeds of the folding members, or else the outer cardboard packages would be required to have large spacings between them in order to provide sufficient time and space for the folding-in procedure. Processing a plurality of outer cardboard packages simultaneously will require a corresponding number of closing tools. A device is moreover necessary that holds the side flaps closed while the outer cardboard packages move on.

The folding-in devices known from prior art require manual adjustments and resetting operations in the instance of the dimensions of the articles and/or boxes to be folded in being changed. Further problems can arise from the relatively complex movement curves that the folding-in devices have to trace in order to be able to fold at nearly the same time two outer cardboard packages being fed one after the other. In addition, the spaces between the boxes can vary according to the pitch of the main conveyor chains. Very small chain pitches in the direction of movement together with very long outer cardboard packages result in relatively small spaces and therefore only very short time slots for folding in the side flaps. Kinematic limits may repeatedly ensue.

SUMMARY OF THE INVENTION

In view of the disadvantages as known from the prior art, it can be regarded as a task of the invention to provide a folding device that makes it feasible to have a higher operating speed together with a simpler, less elaborate, as well as fail-safe and failure-free process management.

This object is fulfilled by a folding device for transporting an outer cardboard package having folding lines (check rest of sentence, too) and for folding at least one side flap of the outer cardboard package, by a packaging facility for articles and by a method for folding at least one side flap of an outer cardboard package having folding lines, the folding device, the packaging facility, and the method comprising the features of the independent claims. Further advantageous embodiments of the invention are described in the dependent claims A packaging facility for articles consists of a plurality of modules or devices that serve to assemble the articles to be packaged into a suitable arrangement and to gather them together in a packaging unit or a bundle by a suitable outer package. Such a packaging facility comprises, for example, a grouping module for assembling a plurality of articles as an article group to be packaged; an outer packaging module, wherein the set of articles is gathered together in a packaging unit or a bundle, as the case may be, by using an outer package; and a palletizing module, where a plurality of packaging units or bundles, as the case may be, are disposed on a pallet for further transport.

The articles can be beverage containers, for example, such as bottles or cans or the like. It can be provided that a plurality of identical or different articles are correspondingly grouped and gathered together by an outer cardboard package. It can also be provided to gather together a specified number of articles by a strapping or a plurality of strappings, by film packaging, or the like, in a bundle or, as the case may be, in a mixed bundle, and to subsequently arrange a plurality of these bundles in an outer cardboard package.

The outer cardboard packages or outer packages that are processed by the folding device described herein can be so-called RSC packages, for example. If "RSC box blanks" are exemplarily referred to within the present application, this is intended to cover other outer packages in this context as well. In particular, die folding device is also suitable for processing other outer package blanks in an appropriate manner, for example outer package blanks for baskets/bottle carriers, outer package blanks for multipacks, or outer package blanks for trays. The folding device according to the invention can likewise be used for the production of so-called side-load boxes, end-load boxes, cartons with only one top flap and/or bottom flap that can in each case substantially cover the entire top opening or bottom opening, respectively, etc.

According to the present invention, the outer packaging module is a folding device or a part of a folding device for the production of an outer cardboard package having folding lines. The invention particularly relates to a folding device for transporting an outer cardboard package having folding lines and for folding at least one side flap of the outer cardboard package. The outer cardboard package is made, for example, of packaging cardboard, that is, of sturdier cardboard that is easily folded. In particular, folding lines are applied onto the cardboard or worked into its structure so that it can be folded, with the folding lines enabling a controlled folding over of partial sections of the cardboard along defined edges. If "outer cardboard packages" are generally referred to within the present application, it is evident to the expert that it is also possible to use other likewise foldable, suitable planar materials. It is, for example, conceivable to use a composite material, for example a plastic-coated cardboard material, a planarly formed but largely sturdy plastic material, or another suitable flat material that can be used for outer packages. Such materials are also intended to be covered by the terms "cardboard" or "outer cardboard package" used herein.

The folding device comprises at least one conveyor system with a guiding unit. At least two transporting units are disposed on the guiding unit, with the transporting units serving for transporting in a transport direction the outer cardboard packages having folding lines. For this purpose, the at least two transporting units are disposed in the transport direction in a row at the conveyor system and are transportable through and/or by the conveyor system. Each of the transporting units comprises its own, individually controllable drive so that each transporting unit can be driven independently of other transporting units in a speed-regulated and/or position-regulated manner at least along a conveyor section of the conveyor system at the guiding unit. Furthermore, each transporting unit has at least one folding unit that serves for folding over at least one side flap of an outer cardboard package and that is accordingly designed.

According to one embodiment of the invention, the at least one folding unit extends away from a receiving area for the outer cardboard package disposed on the transporting unit toward an adjacent transporting unit. In this connection, particularly, the at least one folding unit extends approximately parallel to the transport direction of the conveyor system and is designed as a stop for an outer cardboard package disposed on an adjacent transporting unit. In practice, this means that the folding units essentially take effect and achieve their function in combination and interaction with other folding units and/or transporting units, in particular with folding units and/or transporting units that are in each case adjacent in the transport direction.

According to the invention, it is provided in the method likewise described herein for folding at least one side flap of an outer cardboard package having folding lines that a first outer cardboard package is disposed on a first transporting unit of a conveyor system. The first transporting unit is disposed within the conveyor system to precede a second transporting unit and/or to succeed a third transporting unit at a first spacing. By reducing the spacing between the first transporting unit and the second transporting unit and/or the third transporting unit to a second spacing, at least one side flap of the first outer cardboard package disposed on the first transporting unit is folded over by at least one folding unit associated with the second transporting unit and/or with the third transporting unit, with the side flap/side flaps, which is/are aligned lengthwise a conveying direction of the outer cardboard package, then each being folded in, preferably at right angles with the transport track. In this connection, the at least one folding unit of at least one adjacent transporting unit in each case acts upon the outer cardboard package, while the at least one folding unit of the transporting unit on which the outer cardboard package is disposed does not enter into contact with the outer cardboard package disposed on this transporting unit, and thus does not act upon said outer cardboard package. Instead, the at least one folding unit of the transporting unit on which the outer cardboard package is disposed can act upon another outer cardboard package on a directly adjacent transporting unit, in particular, on the succeeding second transporting unit and/or on the preceding third transporting unit.

The change of the spacing between the first transporting unit and the second transporting unit and/or the third transporting unit is preferably carried out by a change of a transport speed of at least one of the transporting units within the conveyor system.

The conveyor device comprises, for example, a control device that can control each of the transporting units separately and can thus control and regulate the necessary change of the transport speed of at least one of the transporting units within the conveyor system. It can be provided, for example, that the at least two transporting units within the conveyor system are moved at a first basic speed. The transport speed of the succeeding second transporting unit can be increased in relation to the transport speed of the first transporting unit for the purpose of folding over the at least one side flap of the outer cardboard package disposed on the first transporting unit. Alternatively or additionally, the transport speed of the first transporting unit can be increased in relation to the transport speed of the preceding third transporting unit. In particular, a folding unit of the preceding third transporting unit can thus act upon a first side flap of the outer cardboard package and fold in said outer cardboard package at right angles with the conveyor track. A folding unit of the succeeding second transporting unit can additionally act upon a second side flap of the outer cardboard package and fold in said outer cardboard package at right angles with the conveyor track. In this context, the direction of the folding movement of the first side flap is, in particular, opposite to the direction of the folding movement of the second side flap.

According to a further embodiment, the change of the spacing can also be carried out by a reduction of the transport speed of a transporting unit. For instance, the transport speed of the first transporting unit can be reduced in relation to the transport speed of the succeeding second transporting unit. Alternatively or additionally, the transport speed of the preceding third transporting unit can be reduced in relation to the transport speed of the first transporting unit. In particular, a folding unit of the preceding third transporting unit can thus act upon a first side flap of the outer cardboard package and fold in said outer cardboard package, in particular, at right angles with the conveyor track. A folding unit of the succeeding second transporting unit can additionally act upon a second side flap of the outer cardboard package and fold in said outer cardboard package, in particular, at right angles with the conveyor track. In this context, the direction of the folding movement of the first side flap is, in particular, opposite to the direction of the folding movement of the second side flap.

According to an expedient embodiment, it is provided that the transporting units are designed as parts of a linear motor arrangement, where each transporting unit can comprise a part of such a linear motor arrangement. The conveyor system also forms or comprises a part of the linear motor arrangement so that the transporting units can be driven within the conveyor system in a speed-regulated and/or position-regulated manner, where, in particular, the arrangement of the individual transporting units relative to each other or, as the case may be, the spacings between adjacently disposed transporting units or, as the case may be, between transport units disposed one after another in a row in the transport direction, can be adjusted.

According to one embodiment of the invention, the conveyor system comprises a track system with at least two parallelly guided tracks. The track system can, in particular, be a circulating track system in which the transporting units are guided in the transport direction in a first transport area and are guided in an opposite direction to the transport direction in a second transport area. Between the first and the second transport areas, so-called third transport areas or deflection areas are formed.

The transporting units can have, for example, rolls, wheels, or the like, which are guided on the tracks. Optionally, the transporting units can also be equipped with suitable sliding units that enable a low-friction sliding along the longitudinal extension direction of the tracks. It is preferably provided that the track system is, at least in some areas, designed as a stationary stator of a linear motor arrangement, the stator having electromagnets. The transporting units each form the movable part of the linear motor arrangement and preferably each have a part of the linear motor arrangement that corresponds to a rotor of a rotating motor. The track system can be designed as a long stator along its complete movement area for the transporting units. Alternatively, the track system can be equipped with electromagnets only in some areas, and thus be designed as stator of the linear motor arrangement only in some areas. Only the first transport area, where the transporting units are guided in the transport direction, is for example designed as stator of the linear motor arrangement. In the area of the stator of the linear motor arrangement, the transporting units likewise forming a part of the linear motor arrangement can be simply and/or dynamically speed-regulated and/or position-regulated independently of one another.

If the conveyor system is designed as stator of the linear motor arrangement only in some areas, alternative drive units for the transporting units can be associated with the conveyor areas of the conveyor system that are not designed as stator so as to be able to drive the transporting units in these areas as well. Further circulating conveyors, such as chains, drive belts, or suitable traction means, optionally also driven or non-driven wheels or the like, can be disposed between the tracks of the conveyor system, for example. Since it can become very costly to equip the entire conveyor system with electromagnets, such alternative conveyor systems can be used, in particular, to reduce the production costs of the folding device.

According to one embodiment of the invention, it can be provided to form a transporting unit from two partial areas each, with the partial areas being disposed one after another in the transport direction within the conveyor system. In this connection it can be provided, in particular, that each partial area forms a partial receiving area of the transporting unit for the outer cardboard package to be transported through and/or by the conveyor system of the conveyor device and to be processed by folding units of the conveyor device. In this variant it is preferably provided that the two partial areas of the transporting unit are designed to be controllable independently of one another, for example by designing each of the two partial areas as corresponding part of the linear motor arrangement, in particular, in each case as that part of the linear motor arrangement that corresponds to a rotor of a rotating motor. The partial areas can thus in each case be disposed at the conveyor system in specified positions. The two partial areas forming a transporting unit can be disposed, for example, at a specified spacing from each other, whereby the receiving area can be adapted to the size of the outer cardboard package to be transported.

In order to be able to transport the outer cardboard package safely on the transporting unit formed by two partial areas, the partial receiving areas, according to one embodiment of the invention, each have a comb structure with comb teeth, with the free ends of the comb teeth of the one partial area being at least partly arranged between the free ends of the comb teeth of the other partial area, in particular, intermeshing with them. The comb teeth are intermeshed further with each other and the receiving area for the outer cardboard package is reduced by shifting the two partial areas toward each other. If the two partial areas are, by contrast, moved apart from each other, the comb teeth of the one partial area are at least in some areas extracted from out of the interspaces between the comb teeth of the other partial area, and the receiving area for the outer cardboard package is thereby increased.

In this connection, it can optionally be provided that the two partial areas are at least temporarily secured to each other in order to determine the product-specifically adapted arrangement of the two partial areas in relation to each other and in order to prevent said arrangement from changing while transporting an outer cardboard package within the conveyor system, which would lead to disturbances in the production flow.

Alternatively or additionally, it can be provided that the first partial area of the transporting unit formed from two partial areas has in each case first holding units and that the second partial area has in each case second holding units for the outer cardboard package. A spacing between the first holding units and the second holding units can be adjusted corresponding to a length of the outer cardboard package to be transported by shifting the partial areas toward each other or, as the case may be, apart from each other.

According to a further embodiment, it can be moreover provided that at least one of the partial areas comprises at least one folding unit, which is, in particular, suitable for folding over or, as the case may be, for folding in, the side flap of an outer cardboard package disposed on a transporting unit directly adjacent to said partial area. Each of the two partial areas preferably has in each case at least one folding unit associated with it, with the folding units extending away from the particular other partial area and parallel to the transport direction of the conveyor system. Thus, for example, a first folding unit disposed on the first partial area of the transporting unit and extending toward a succeeding transporting unit serves for folding over a side flap of an outer cardboard package located on the succeeding transporting unit. Accordingly, a second folding unit disposed on the second partial area, which is arranged in the transport direction ahead of the first partial area, and extending toward a preceding transporting unit serves for folding over a side flap of an outer cardboard package located on the preceding transporting unit. The at least one side flap of the outer cardboard package located on the transporting unit is, by contrast, processed by a folding unit of the preceding and/or of the succeeding transporting unit.

In the conveyor device described here, the side flaps of a box blank that are disposed to be aligned longitudinally along the transport direction are folded in at approximately right angles with the conveyor track by the folding units of adjacent transporting units, with the box blank, as the case may be, being already partly folded and, as the case may be, having a set of articles already arranged on it. In this connection, the already present drives of the individual transporting units serving for the movement of the individual transporting units in the transport direction are used for closing the side flaps. Thus, closing the side flaps requires no distinct drive mechanisms. The side flaps that have been closed by the folding units are held by the folding units during the further transport within the conveyor system of the folding device so that no additional guide rails or other holding devices are necessary during the further transport through/by the folding device.

It is furthermore conceivable to design the folding units on the transporting units such that at least one top flap on a top side of an outer cardboard package disposed on an adjacent transporting unit can be folded over or folded in, as the case may be. For this purpose, corresponding folding fingers have to be formed, for example, on a parallel plane above the conveying surface of the conveyor system and in each case leading away from the transporting unit toward the adjacent transporting unit. In order to be able to use the folding device for different box heights in a simple way, it is in this instance preferably provided to form a frame unit of the transporting unit on which the folding unit is disposed to be variable in height. In this exemplary embodiment, for example, the top side of an outer package can be closed by a feeding movement of adjacent transporting units toward each other, with the outer package being closed on the bottom side and disposed on a transporting unit of the folding device, the outer package being, for example, an RSC cardboard package that has been filled with articles by a top-load method.

The folding units on the transporting units can be designed to be variable and/or exchangeable in order to be able to adapt the folding device in a simple way to new requirements and/or to changed geometries of the outer packages in the instance of a change of product. It can be provided, for example, to form the folding units to be length-variable parallel to the linear areas of the conveyor system. A folding unit can thus be formed by, for example, at least two areas designed to be shiftable in relation to each other and disposed parallel to the linear area of the conveyor system, where said two areas can be shifted relative to each other in order to correspondingly change the length of the folding unit. The folding units can alternatively be designed to be telescoping. In particular for transporting units that are designed in two parts with first and second partial areas being differently arrangeable relative to each other, where the transporting units are suitable for transporting and processing different box sizes, it can be necessary to adapt the length of the folding units according to the box sizes and flap sizes.

It is likewise conceivable to design the folding units as exchangeable format parts that can be exchanged as required for a change of product in order to adapt the transporting units in each case to the new product. Such a format change can optionally be carried out manually; the format change can also be carried out in an automated process, for example, by a robot or the like. Such a robot can preferentially be disposed in the area of the deflection of a circulating conveyor system. The robot can particularly be permanently disposed in this area without disturbing the production flow, since the feeding movement of the transporting units toward each other for folding the box flaps takes place particularly in the linear region of the upper strand of the conveyor system.

The exchange of the folding units is necessary, in particular, if a production change between top-load loading and side-load loading is to take place. A top-load loading is to be understood as placing the articles from above into an outer package that is open at the top. A side-load loading is to be understood as sliding the articles from the side into an outer package with an opening at the side. A further advantage of the folding device described here thus lies therein that it can be used both for top-load loading and for side-load loading. Only a simple format change of the folding units is necessary for this purpose, with the folding units, in particular, needing to be disposed differently on the transporting units in order to be able to fold in the corresponding flaps.

A further advantage of the system lies therein that no large spacings are necessary between the sets of articles to be packaged into a bundle and/or between the box blanks or, as the case may be, outer cardboard packages, to be transported and processed within the folding device in order to fold in the side flaps by suitable devices, because the folding units of a transporting unit act upon the outer cardboard package on a particular adjacent transporting unit by a reduction of the spacing between the transporting units within the conveyor system. Only an initial spacing between the transporting units is required to ensure that the at least one folding unit of a transporting unit does not engage into the receiving area of an outer cardboard package of a directly adjacent transporting unit. The folding device can be particularly used for producing bundles and/or outer packages with inside side flaps, such as so-called wraparound packages, for producing trays, or for loading already partly pre-folded outer cardboard packages from the side. However, applications are also conceivable in which outside side flaps are closed. In this instance, an adhesive application module can additionally be associated with the folding device, which module applies appropriate adhesion points onto surfaces of the outer cardboard package that are arranged parallel to the transport direction, where subsequently a contact between the adhesion point/s and the side flap/s folded over by the folding units is formed and the side flap/s is/are thus secured in their position.

A packaging facility with a folding device having the features described above can provide, for example, that an already pre-glued RSC cardboard package is expanded to the box form open on two sides and then inserted into a transporting unit of a folding device described above such that the openings are in each case arranged on a plane that is parallel to the transport direction of the transporting units. The open inside flaps on one side of the RSC box are subsequently folded in or, as the case may be, folded over, by a feeding movement of the transporting units relative to each other. Then, the articles are placed into the RSC box by sliding them in from the side through the opposite open side. The feeding of the articles in this context is carried out essentially perpendicular to the transport direction of the transporting units within the folding device. Afterward, the transporting units with the RSC box that is closed on one side and loaded with articles can be moved to a further module of the packaging facility, where the still open side of the RSC box is closed. For this purpose, in particular, an adhesive can be applied onto the outer side of the inside flap that is folded in in the folding device. Subsequently, the bottom and top outside flaps are folded over onto the inside side flaps, thus forming a closed RSC box. Instead of a bottom and a top outside flap, the RSC box can optionally also provide only one large outside flap that is folded over onto the side flaps from above or from below. In order to realize this, the RSC box that is closed on one side and loaded with articles can, for example, be transferred onto transporting units of a further folding device, which can have the appropriate folding units such that closing the flaps as described above is carried out by a feeding movement of adjacent transporting units.

Closing the still open side after filling an outer package that is open on one side with articles can be provided immediately subsequently; in particular, the outer packages that are open on one side can be transposed onto analogously formed transporting units with appropriately disposed or designed folding units for closing the remaining opening. The articles are then filled in and the opening of the outer package is closed by a feeding movement of adjacent transporting units toward each other. This is particularly advantageous for outer packages where the last opening is not closed by four flaps, but rather by only two flaps located opposite each other. The flaps can afterwards be additionally secured with an adhesive tape or the like. The described procedure can be carried out either in cycle operation or in a continuous process. According to an alternative embodiment, the packaging facility can also provide or comprise, as the case may be, a folding device in which the passively acting folding units are disposed on both sides on the transporting units parallel to the transport direction such that the inside side flaps on both sides of the expanded RSC box or of another suitable box blank can be closed simultaneously. In this instance, the already pre-glued RSC box, for example, is taken from a magazine, is expanded into the box form that is open on both sides, is loaded with articles, and only subsequent thereto are both side openings closed. In this context it can again be advantageous to first dispose the RSC box blank on a suitable transporting unit with appropriate folding units, to then fill the box, and to close it immediately afterward.

BRIEF DESCRIPTION OF THE FIGURES

In the following passages, the attached figures further illustrate exemplary embodiments of the invention and its advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

Figure 1:
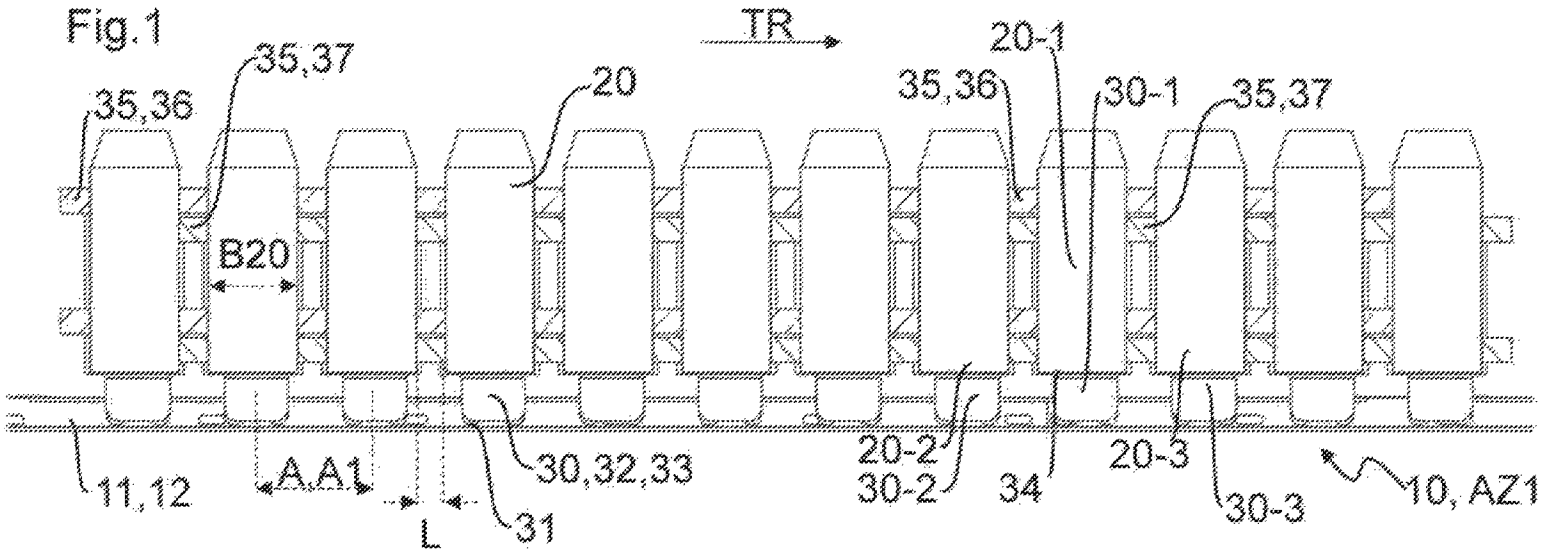
FIG. 1 shows a first operating state of a first embodiment of a folding device for closing carton side flaps, with the carton side flaps of the outer cardboard packages still being open.

The same or equivalent elements of the invention are designated using identical reference characters. Furthermore and for the sake of clarity, only the reference characters relevant for describing the individual figures are provided. It should be understood that the detailed description and specific examples of the embodiments of the device and of the method according to the invention or of the packaging facility according to the invention are intended for purposes of illustration only and are not intended to limit the scope of the invention.

DETAILED DESCRIPTION OF THE INVENTION

Figure 2:
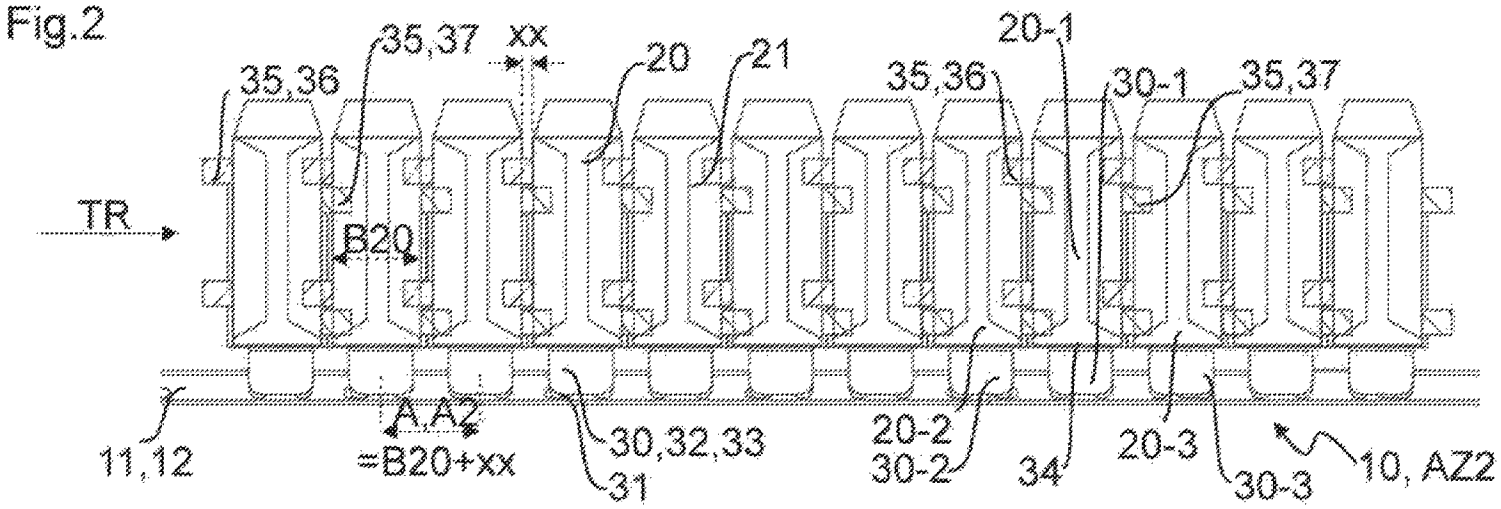
FIG. 2 shows a second operating state of a first embodiment of a folding device for closing carton side flaps according to FIG. 1, with the carton side flaps of the outer cardboard packages having been closed.

The schematic illustration in FIG. 1 shows a first operating state AZ1 of a first embodiment of a folding device 10 for closing carton side flaps 21, with the carton side flaps 21 (not visible in FIG. 1) of the outer cardboard packages 20 still being open, that is, not yet closed. The schematic presentation of FIG. 2 shows a second operating state AZ2 of the folding device 10 according to FIG. 1, with the carton side flaps 21 of the outer cardboard packages 20 having been closed.

The folding device 10 comprises a at least one conveyor system with a guiding unit. The guiding unit can be a track system 11, formed, for example, of two parallel, circulating tracks 12. At least two transporting units, for example circulating movable conveyor units are arranged on the tracks 12. In the following passages the transporting units are referred to as transporting and folding shuttles 30. The at least two transporting and folding shuttles 30 are disposed in a transport direction TR in a row on the track system 11 and are transportable through and/or by the guiding unit or track system 11. The transporting and folding shuttles 30 serve for transporting outer cardboard packages 20 having folding lines in the transport direction TR. The track system 11 can be a circulating track system 11 in which the transporting and folding shuttles 30 are guided in the transport direction TR in a first transport section or area T1 and are guided in an opposite direction to the transport direction TR in a second transport section or area T2. Between the first and the second transport sections or areas T1, T2, so-called third transport sections or deflection areas T3 are located.

Said transporting and folding shuttles 30 are designed to be movable on the tracks 12 of the track system 11 by way of, for example, rolls 31, wheels, or the like. Optionally, the transporting and folding shuttles 30 can also be equipped with suitable sliding units that enable a low-friction sliding along the longitudinal extension direction of the tracks 12. Each transporting and folding shuttle 30 preferably has its own drive 32, in particular a linear motor 33, by way of which each individual transporting and folding shuttle 30 within the folding device 10 is individually controllable and/or drivable.

Each transporting and folding shuttle 30 preferably has holding units (not illustrated), with which the outer cardboard package 20 to be transported and folded can be at least temporarily secured on or at the transporting and folding shuttle 30. Each transporting and folding shuttle 30 furthermore has at least one folding unit 35 for folding over carton side flaps 21. Especially, the at least one folding unit 35 extends away from a receiving area 34 of the holding unit for the outer cardboard package 20 disposed on the transporting and folding shuttle 30 toward an adjacent transporting and folding shuttle 30. Particularly, the at least one folding unit 35 extends approximately parallel to the transport direction TR of the conveyor system or track system 11 and is designed as a stop for an outer cardboard package 20 disposed on an adjacent transporting and folding shuttle 30. In practice, this means that the folding units 35 essentially take effect and achieve their function in combination and interaction with other folding units 35 of adjacent transporting and folding shuttles 30.

According to the embodiment illustrated here, it is provided that each first transporting and folding shuttle 30, 30-1 has at least one first folding unit 36 for folding over a side flap 21 of a second outer cardboard package 20-2 and at least one second folding unit 37 for folding over a side flap 21 of a third outer cardboard package 20-3. It should be noted in this context that the folding units 35, 36, 37 of a transporting and folding shuttle 30-1 do not serve for folding side flaps 21 of the outer cardboard package 20-1 located on the transporting and folding shuttle 30-1 itself. Instead, a side flap 21 of the outer cardboard package 20-2 located on an adjacent transporting and folding shuttle 30-2 is folded by the at least one first folding unit 36 of the transporting and folding shuttle 30-1. Furthermore, a side flap 21 of the outer cardboard package 20-3 located on an adjacent transporting and folding shuttle 30-3 is folded by the at least one second folding unit 37 of the transporting and folding shuttle 30-1. The folding units 35 of a transporting and folding shuttle 30, 30-1 thus each act upon the outer cardboard packages 20-2, 20-3 located on the directly adjacent transporting and folding shuttles 30, 30-2, 30-3. In particular, the folding units 35, 36, 37 of a transporting and folding shuttle 30, 30-1 do not serve for folding over side flaps 21 of an outer cardboard package 20, 20-1 being transported by the same transporting and folding shuttle 30, 30-1.

For the method of folding at least one side flap 21 of an outer cardboard package 20 having folding lines, a first outer cardboard package 20-1 is disposed within the conveyor system on a first transporting and folding shuttle 30-1 on the track system 11. In order to effect in an easy way the above-described processes of folding over or folding in, as the case may be, of side flaps 21 of outer cardboard packages 20-2, 20-3 located in each case on adjacent transporting and folding shuttles 30-2, 30-3, the folding units 35, 36, 37 are designed such that they extend in the transport direction TR parallel to the tracks 12 away from a receiving or support area 34 for the outer cardboard package 20, 20-1, in each case toward an adjacent transporting and folding shuttle 30-2, 30-3. The first transporting and folding shuttle 30-1 is disposed on the track system 11 of the conveyor system to precede a second transporting and folding shuttle 30-2 and/or to succeed a third transporting and folding shuttle 30-3 at a first spacing. By reducing the spacing A1 between the first transporting and folding shuttle 30-1 and the second transporting and folding shuttle 30-2 and/or the third transporting and folding shuttle 30-3 to a second spacing A2, at least one side flap 21 of the first outer cardboard package 20-1 disposed on the first transporting and folding shuttle 30-1 is folded over by at least one folding unit 35 associated with the second transporting and folding shuttle 30-2 and/or with the third transporting and folding shuttle 30-3, with the side flap/side flaps 21, which is/are aligned lengthwise the transport direction TR of the outer cardboard package 20-1, then each being folded in, preferably at right angles with the track system 11. In this connection, the at least one folding unit 35 of at least one adjacent transporting and folding shuttle 30-2, 30-3 in each case acts upon the outer cardboard package 20-1, while the at least one folding unit 35 of the transporting and folding shuttle 30-1 on which the outer cardboard package 20-1 is disposed does not enter into contact with the outer cardboard package 20-1 disposed on this transporting and folding shuttle 30-1 or receiving area 34, and thus does not act upon said outer cardboard package 20-1. Instead, the at least one folding unit 35 of the transporting and folding shuttle 30-1 on which the outer cardboard package 20-1 is disposed can act upon another outer cardboard package 20 on a directly adjacent transporting and folding shuttle 30, in particular, on the succeeding second transporting and folding shuttle 30-2 and/or on the preceding third transporting and folding shuttle 30-3.

Thus, closing the side flaps 21 requires no distinct drive mechanisms. The side flaps 21 that have been closed by the folding units 35 are held by the folding units 35 during the further transport within the track system 11 of the folding device 10 so that no additional guide rails or other holding devices are necessary during the further transport through and/or by the folding device 10.

In the first operating state AZ1 illustrated in FIG. 1, the transporting and folding shuttles 30 have a medium-sized spacing A1. The spacing A1 is to be selected at least sufficiently large for the folding units 35, 36, 37 of a transporting and folding shuttle 30-1 not to be able to act upon the side flaps 21 of the outer cardboard packages 20-2, 20-3 disposed on the directly adjacent transporting and folding shuttles 30-2, 30-3. The medium-sized spacing A1 preferably corresponds to at least one width B20 of an outer cardboard package 20 and one length L of at least one folding unit 35, which extends beyond the width B20 of the outer cardboard package 20.

By reducing the spacing A1 to a spacing A2 corresponding to nearly one width B20 of an outer cardboard package 20, or, as the case may be, to one width B20 of an outer cardboard package 20 plus a slight spacing xx, the folding units 35, 36, 37 act upon the particular adjacent side flap 21 of an outer cardboard package 20 on a directly adjacent transporting and folding shuttle 30, whereby the outer cardboard package 20 is folded over and/or folded in along the die-cut folding line of the outer cardboard package 20.

The spacing A between adjacent transporting and folding shuttles 30 is, in particular, reduced by the speed of a succeeding transporting and folding shuttle 30, 30-1 being increased in relation to the speed of a transporting and folding shuttle 30, 30-3 preceding in the transport direction TR. This is easily feasible, in particular, due to the individually controllable linear motors 33.

In particular when using a plurality of transporting and folding shuttles 30 disposed in a row at the track system 11, it can then be provided that the speed of the transporting and folding shuttles 30 disposed further in the back as seen in the transport direction TR has to be significantly higher during transfer of the folding device 10 from a first operating state AZ1 to a second operating state AZ2 in comparison to the speed of the transporting and folding shuttles 30 disposed further in the front as seen in the transport direction TR. This applies in particular when all transporting and folding shuttles 30 are to be transferred synchronously from the first operating state AZ1 according to FIG. 1 with a spacing A1 between the transporting and folding shuttles 30 to the second operating state AZ2 according to FIG. 2 with a spacing A2 between the transporting and folding shuttles 30. It can be alternatively provided that the transporting and folding shuttles 30 are not simultaneously but successively advanced toward each other and the outer cardboard packages 20 thus successively processed.

According to a further embodiment, the change of the spacing A can also be carried out by a reduction of the transport speed of a transporting and folding shuttle 30. For instance, the transport speed of the first transporting and folding shuttle 30-1 can be reduced in relation to the transport speed of the succeeding second transporting and folding shuttle 30-2. Alternatively or additionally, the transport speed of the preceding third transporting and folding shuttle 30-3 can be reduced in relation to the transport speed of the first transporting and folding shuttle 30-1. In particular, a folding unit 35 of the preceding third transporting and folding shuttle 30-3 can thus act upon a first side flap 21 of the outer cardboard package 20-1 and fold in said outer cardboard package 20-1, in particular, at right angles with the track system 11. A folding unit 35 of the succeeding second transporting and folding shuttle 30-2 can additionally act upon a second side flap 21 of the outer cardboard package 20-1 and fold in said outer cardboard package 20-1, in particular, at right angles with the track system 11. In this context, the direction of the folding movement of the first side flap 21 is, in particular, opposite to the direction of the folding movement of the second side flap 21.

Figures 3, 4, 5, 6:
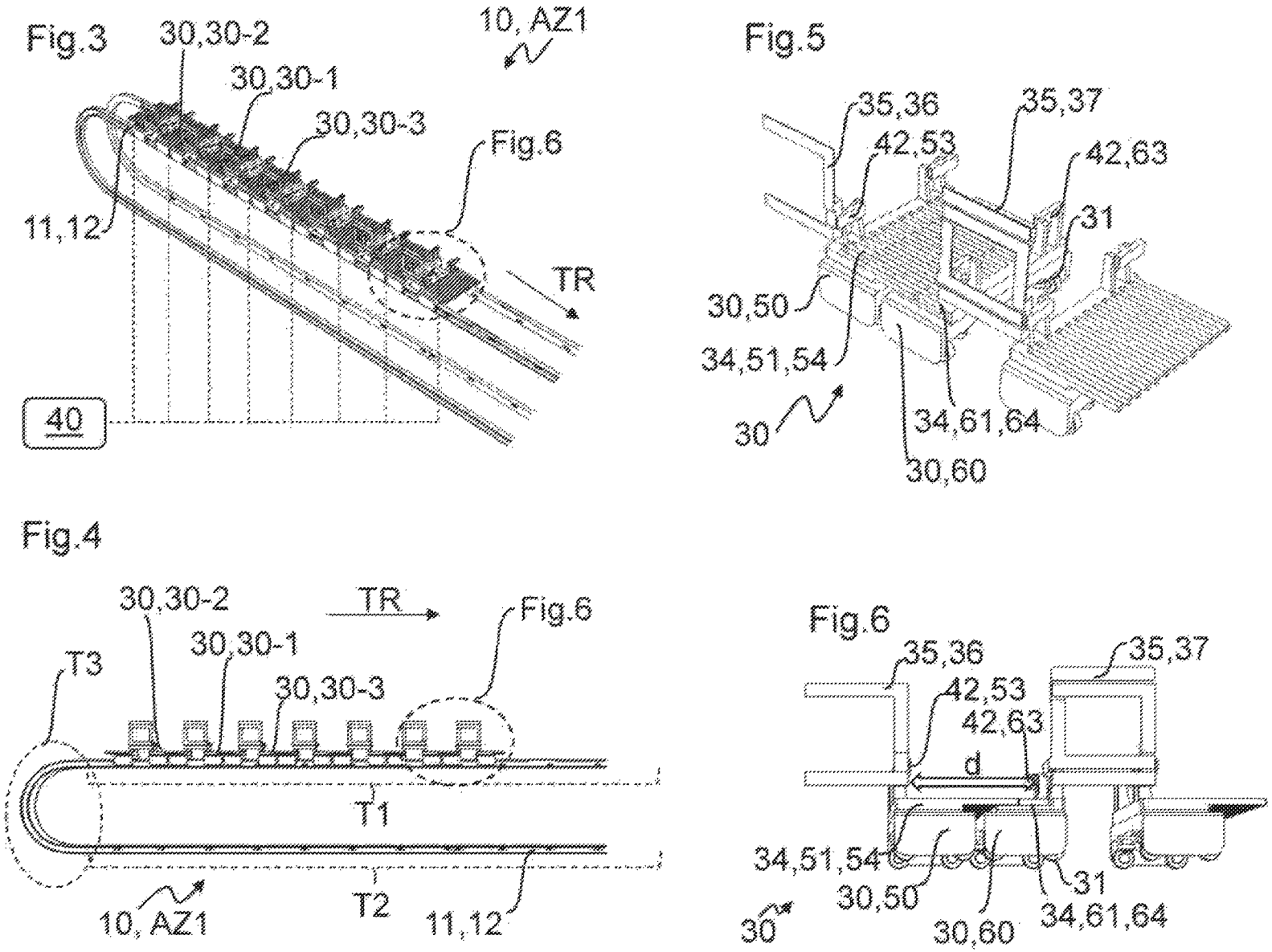
FIG. 3 shows a perspective illustration of a second embodiment of a folding device for closing carton side flaps, with no outer cardboard packages shown.
FIG. 4 shows a lateral illustration of a second embodiment of a folding device for closing carton side flaps according to FIG. 3, with no outer cardboard packages shown.
FIG. 5 shows a detail from FIG. 3.
FIG. 6 shows a detail from FIG. 4.
Figure 7:
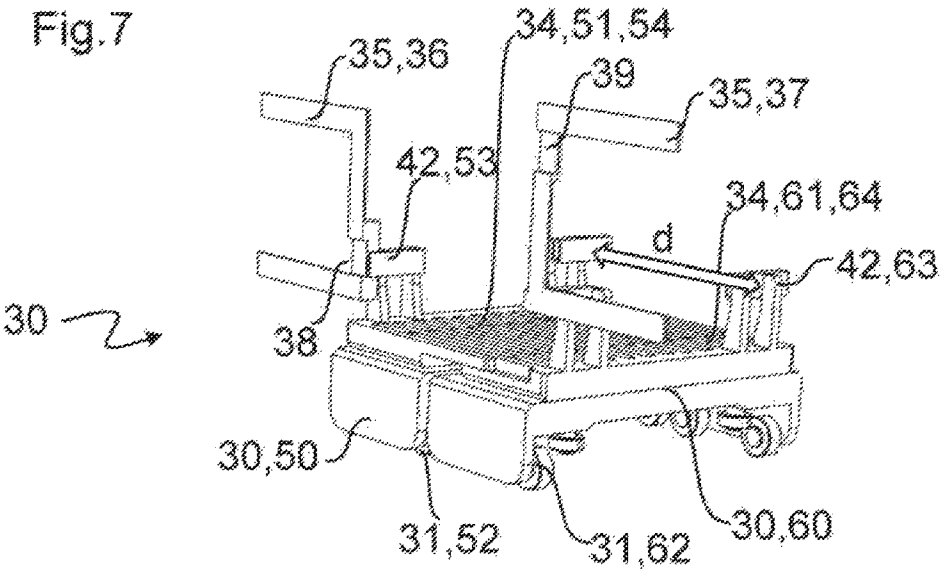
FIG. 7 shows in detail an embodiment of a two-part transporting and folding shuttle.
Figure 9:
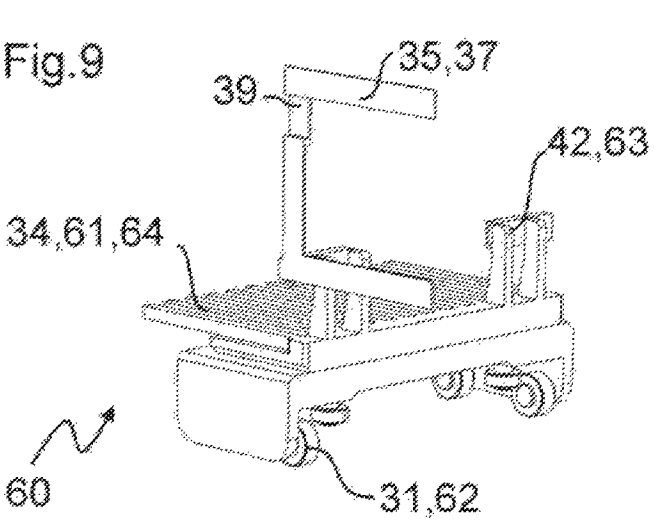
FIG. 9 shows in detail an embodiment of a second partial area of a two-part transporting and folding shuttle according to FIG. 7.
Figure 8:
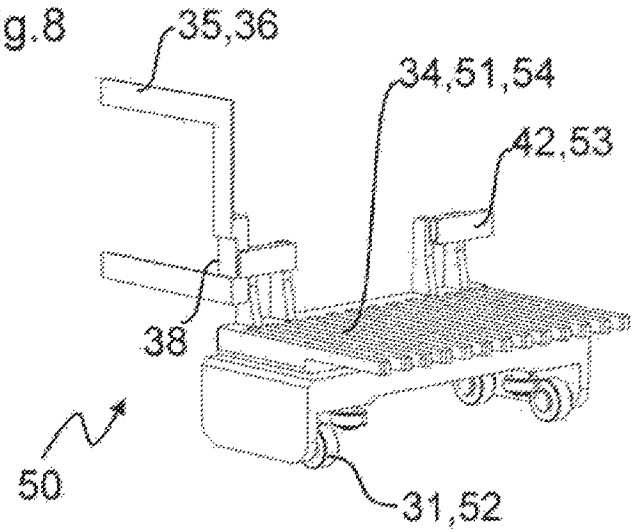
FIG. 8 shows in detail an embodiment of a first partial area of a two-part transporting and folding shuttle according to FIG. 7.
Figure 10:
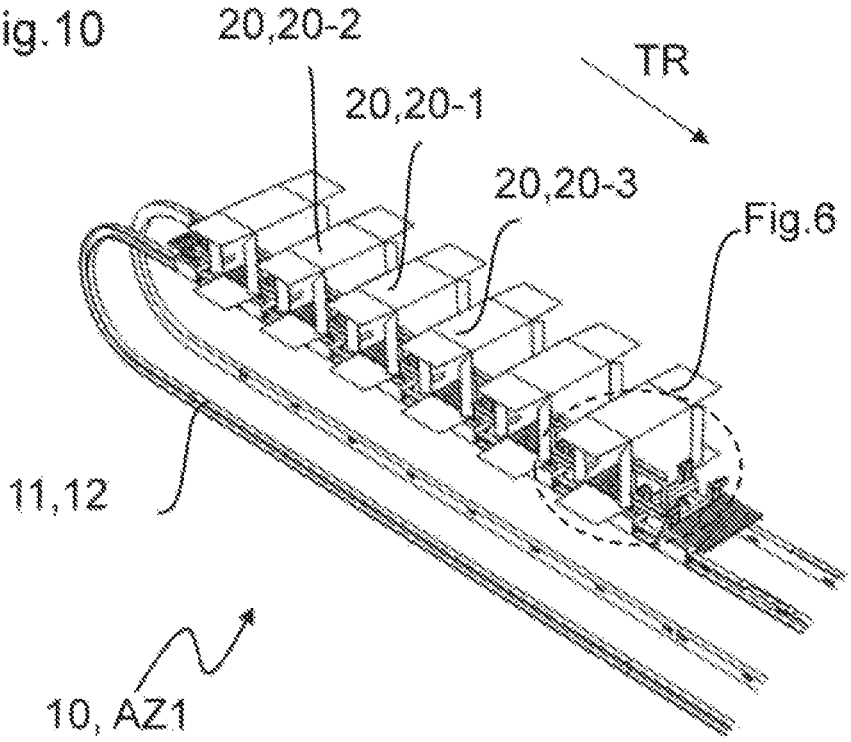
FIG. 10 shows a perspective illustration of a second embodiment of a folding device for closing carton side flaps with outer cardboard packages in a first operating state, with the carton side flaps of the outer cardboard packages still open.

FIG. 3 shows a perspective illustration and FIG. 4 shows a lateral illustration of a second embodiment of a folding device 10 for closing carton side flaps, with no outer cardboard packages shown in each case. The perspective view in FIG. 5 shows a detail from FIG. 3, and the side view in FIG. 6 shows a detail from FIG. 4. Furthermore, FIG. 7 shows in detail an embodiment of a two-part transporting and folding shuttle 30 as is used in the second embodiment of the folding device 10 according to FIGS. 3 to 6. FIG. 8 shows in detail the first partial area 50 of a two-part transporting and folding shuttle 30 according to FIG. 7, and FIG. 9 shows in detail a second partial area 60 of a two-part transporting and folding shuttle 30 according to FIG. 7.

The folding device 10 according to the second embodiment likewise comprises a track system 11 with two parallel, circulating tracks 12 on which circulatingly movable transporting and folding shuttles 30 are arranged. Said transporting and folding shuttles 30 are likewise designed to be movable by way of rolls 31, wheels, or the like, and each transporting and folding shuttle 30 preferably has its own drive (not illustrated), in particular a part of a linear drive or linear motor arrangement, by way of which each individual transporting and folding shuttle 30 within the folding device 10 is individually controllable and/or drivable.

The track system 11 can be designed as a long stator or stationary stator along its complete movement area for the transporting and folding shuttles 30. Alternatively, the track system 11 can be equipped with electromagnets only in some areas, and thus be designed as stator of the linear motor arrangement only in some areas. In particular, the track system 11 is, at least in some areas, designed as a stationary stator of a linear motor arrangement, the stator having electromagnets, whereas the transporting and folding shuttles 30 each have a movable part of the linear motor arrangement that is preferentially formed by permanent magnets and corresponds to a rotor of a rotating motor. The linear motor arrangement described herein in the present instance thus consists of a track system 11 that is at least in some areas designed as long stator and of a plurality of transporting and folding shuttles 30 that are individually controllable movable thereon. In particular, the transporting and folding shuttles 30 can be simply and/or dynamically speed-regulated and/or position-regulated independently of one another. According to one embodiment, it can be provided that the track system 11 is designed as stator of the linear motor arrangement only in a first transport section T1 where the transporting and folding shuttles 30 are moved in the transport direction TR. In particular, there are no electromagnets disposed in the second transport section T2 and in the deflection areas T3. These transport sections or areas T2, T3 can have alternative drive units for the transporting and folding shuttles 30. The transporting and folding shuttles 30 can be economically driven in these areas, for example, by friction lock and/or force lock by way of further circulating conveyors disposed between the tracks 12, for example chains and/or wheels. It can be alternatively provided to equip the entire track system 11 along its complete orbit with electromagnets as so-called long stator, but this is costlier than the alternative described above.

Furthermore illustrated in FIG. 3 is a control device 40 associated with the folding device 10, the control device 40 being coupled in terms of control technology with each transporting and folding shuttle 30, in particular with each rotor of the particular transporting and folding shuttles 30, such that each transporting and folding shuttle 30 can be individually controlled for individually adjusting its position and/or speed.

According to one embodiment of the invention, an increase, in particular, of the transport speed of in each case succeeding transporting and folding shuttles 30 is effected within the first transport section T1 by the control device 40, with transporting and folding shuttles 30 disposed further in the back as seen in the transport direction TR having to be more accelerated than transporting and folding shuttles 30 disposed at the beginning of the row as seen in the transport direction TR. It can be alternatively provided that the transporting and folding shuttles 30 preceding in the transport direction TR are decelerated, with transporting and folding shuttles 30 disposed in the front as seen in the transport direction TR having to be more decelerated than transporting and folding shuttles 30 succeeding in the transport direction TR.

Under certain conditions it can, however, also be necessary to also move a transporting and folding shuttle 30 within the first transport section T1 opposite to the transport direction TR. This movement, too, is preferably controlled by way of the control device 40.

Each transporting and folding shuttle 30 preferably has holding units 42, with which or, as the case may be, between which the outer cardboard package (not illustrated) to be transported and folded can be at least temporarily secured on or at the transporting and folding shuttle 30. Each transporting and folding shuttle 30 furthermore has at least one folding unit 35 for folding over carton side flaps 21.

According to the embodiment illustrated here, in particular, in detail in the FIGS. 7 to 9, it is provided that each transporting and folding shuttle 30 consists of two partial areas 50, 60 acting together in holding the outer cardboard package. It is preferably provided that the two partial areas 50, 60 of the transporting and folding shuttle 30 are designed to be controllable independently of one another. This is achieved for example, by designing each of the two partial areas 50, 60 as corresponding part of a linear motor arrangement in each case formed as linear motor, such that the two partial areas 50, 60 of a two-part transporting and folding shuttle 30 described herein are each individually speed-variable and/or position-variable. The partial areas 50, 60 can thus in each case be disposed at the track system 11 in specified positions. The two partial areas 50, 60 forming a transporting and folding shuttle 30 can be disposed, for example, at a specified spacing d from each other, whereby the receiving or support area 34 can be adapted to the size of the outer cardboard package to be transported. It can be alternatively provided that only one of the two partial areas 50, 60 is speed-variable and/or position-variable.

A first partial area 50, in particular, comprises first rolls 52 forming a part of the roller system 31 by way of which the transporting and folding shuttle 30 is movably disposed on the track system 11. The first partial area 50 further has a first comb-shaped receiving or support area 51 with first comb teeth 54 and first holding units 53 for the outer cardboard package to be transported and folded. At least one first folding unit 36 is moreover associated with the first partial area 50. A second partial area 60 comprises second rolls 62, which together with the first rolls 52 form the roller system 31. The second partial area 60 further has a second comb-shaped receiving or support area 61 with second comb teeth 64 and second holding units 63 for the outer cardboard package to be transported and folded. At least one second folding unit 37 is moreover associated with the second partial area 60.

The outer cardboard package to be transported and folded is held clampingly between the first holding units 53 of the first partial area 50 and the second holding units 63 of the second partial area 60.

In order to be able to transport the outer cardboard package safely on the transporting and folding shuttle 30 formed by two partial areas 50, 60, the comb teeth 54, 64 of the partial receiving or support area 51, 61 intermesh with each other at least partially. The receiving or support area 34 for the outer cardboard package is formed by the first comb-shaped receiving or support area 51 of the first partial area 50 and the second comb-shaped receiving or support area 61 of the second partial area 60. It is, in particular, provided that the first comb teeth 54 are disposed between the second comb teeth 64. The first comb teeth 54 can be intermeshed further between the second comb teeth 64 or else the first comb teeth 54 are at least partly extracted from between the second comb teeth 64 by shifting the first partial area 50 relative to the second partial area 60 along the tracks 12. In this manner, the spacing d between the first and second holding units 53, 63 can be easily changed and appropriately adjusted to the size of the outer cardboard package to be transported and folded. The folding device 10 can thus be easily employed for processing a multitude of differently formed outer cardboard packages without requiring an elaborate exchange of format parts for the product-specific adaptation of the folding device 10.

Optionally, it may be provided, that the two partial areas 50, 60 are at least temporarily secured to each other in order to determine the product-specifically adapted arrangement of the two partial areas 50, 60 in relation to each other and in order to prevent said arrangement from changing while transporting an outer cardboard package within the track system 11, which would lead to disturbances in the production flow.

As already described above in detail in the context of the FIGS. 1 and 2, the folding units 35, 36, 37 of a transporting and folding shuttle 30, 30-1 do not serve for processing the outer cardboard package disposed on said transporting and folding shuttle 30. Instead, the first folding units 36 of the first partial area 50 of the transporting and folding shuttle 30, 30-1 serve for processing an outer cardboard package on the transporting and folding shuttle 30, 30-2 directly succeeding in the transport direction TR. Accordingly, the second folding units 37 of the second partial area 60 of the transporting and folding shuttle 30, 30-1 serve for processing an outer cardboard package on the transporting and folding shuttle 30, 30-3 directly preceding in the transport direction TR.

This is, in particular, illustrated in the FIGS. 10 to 17, which additionally show the outer cardboard packages 20 disposed on the transporting and folding shuttles 30, with the FIGS. 10 to 13 showing views analogously to the FIGS. 3 to 6, in which the folding device 10 is in a first operating state AZ1, with the carton side flaps 21 of the outer cardboard packages 20 being open. The FIGS. 14 to 17, by contrast, show views analogously to the FIGS. 3 to 6, in which the folding device 10 is in a second operating state AZ2, with the carton side flaps 21 of the outer cardboard packages 20 being closed.

In order to realize the processes of folding over or folding in, as the case may be, of side flaps 21 of outer cardboard packages 20-2, 20-3 located in each case on adjacent transporting and folding shuttles 30-2, 30-3, the folding units 35, 36, 37 of the intermediately disposed adjacent transporting and folding shuttle 30-1 are designed such that they extend in the transport direction TR parallel to the tracks 12 away from a receiving or support area 34 for the outer cardboard package 20, 20-1, in each case toward the adjacent transporting and folding shuttles 30-2, 30-3. When transferring the folding device 10 from a first operating state AZ1 according to FIG. 10 to a second operating state AZ2 according to FIG. 14, the processes of folding over or, as the case may be, folding in, of side flaps 21 is carried out in the same manner as already described in detail above in the context of the FIGS. 1 and 2.

Figure 12:
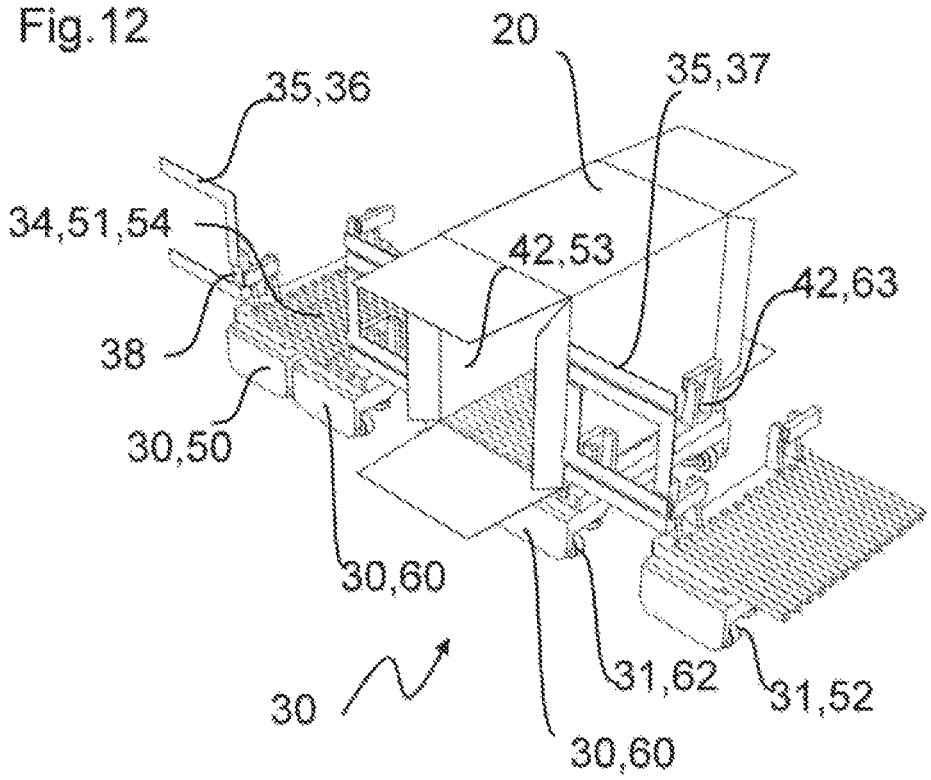
FIG. 12 shows a detail from FIG. 10.
Figure 13:
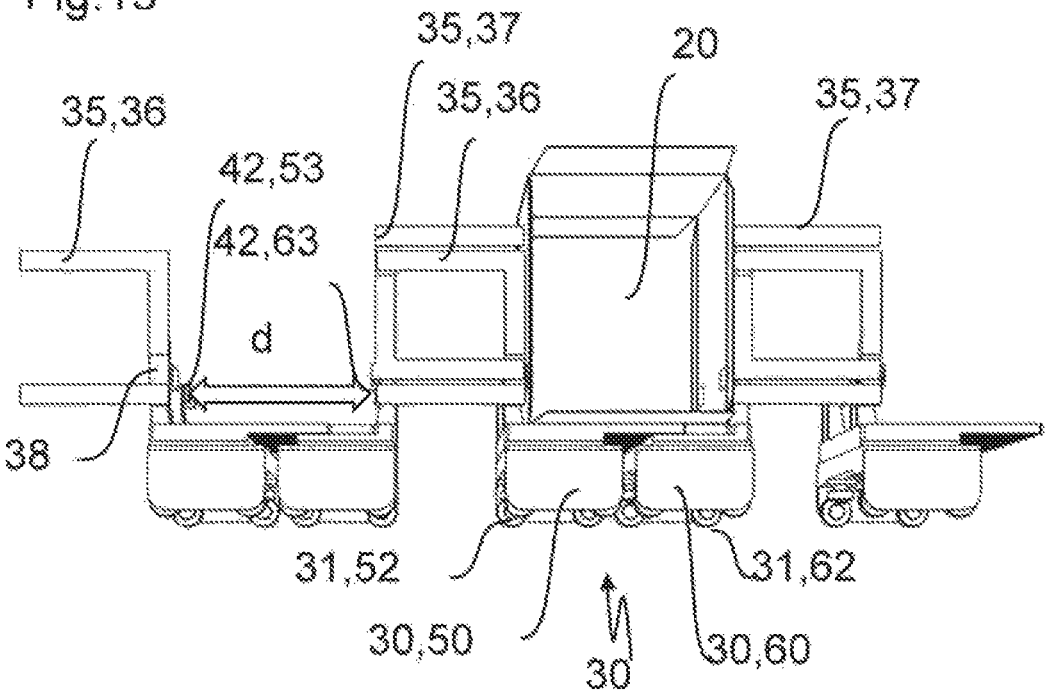
FIG. 13 shows a detail from FIG. 11.
Figure 14:
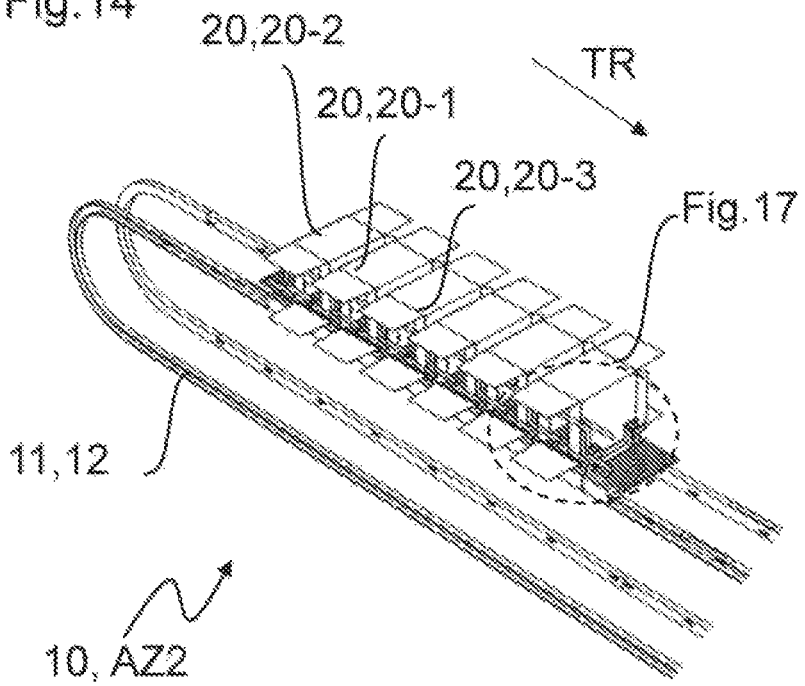
FIG. 14 shows a perspective illustration of a second embodiment of a folding device for closing carton side flaps with outer cardboard packages in a second operating state, with the carton side flaps of the outer cardboard packages having been closed.
Figure 16:
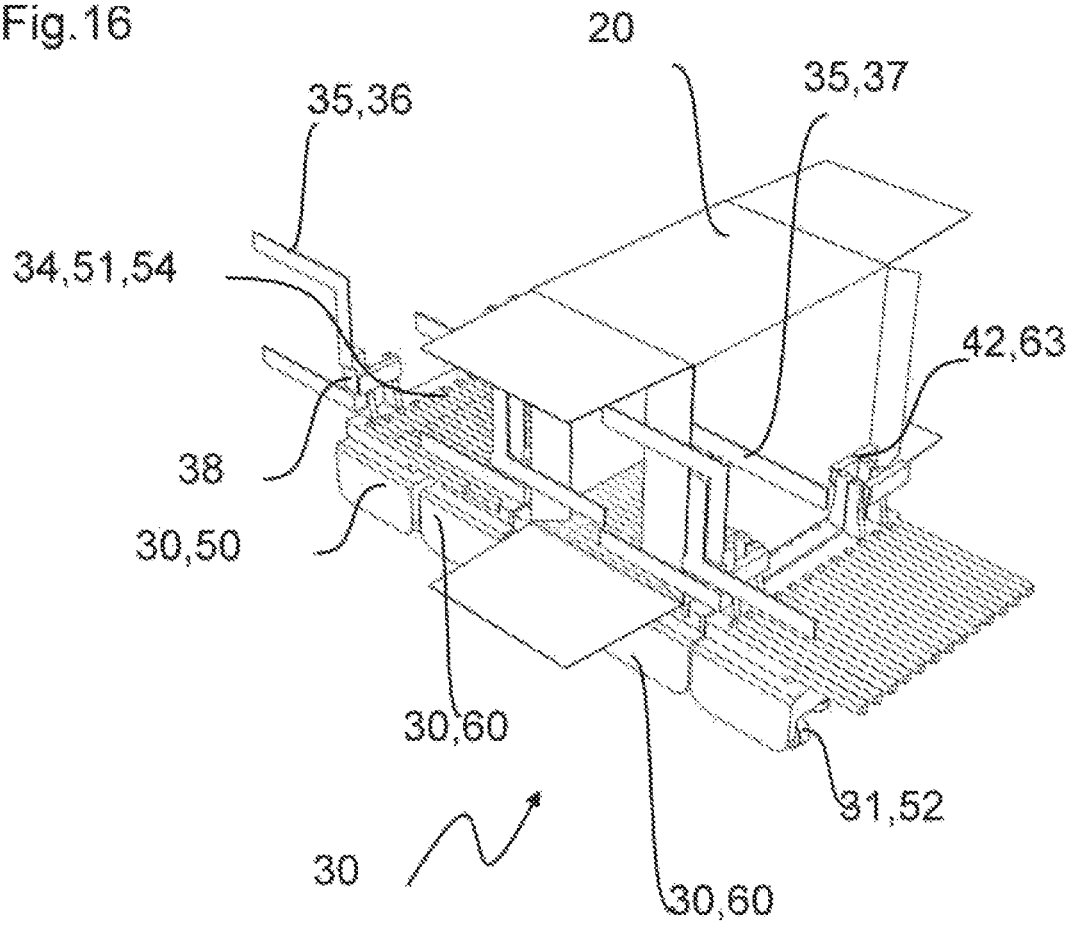
FIG. 16 shows a detail from FIG. 14.
Figure 17:
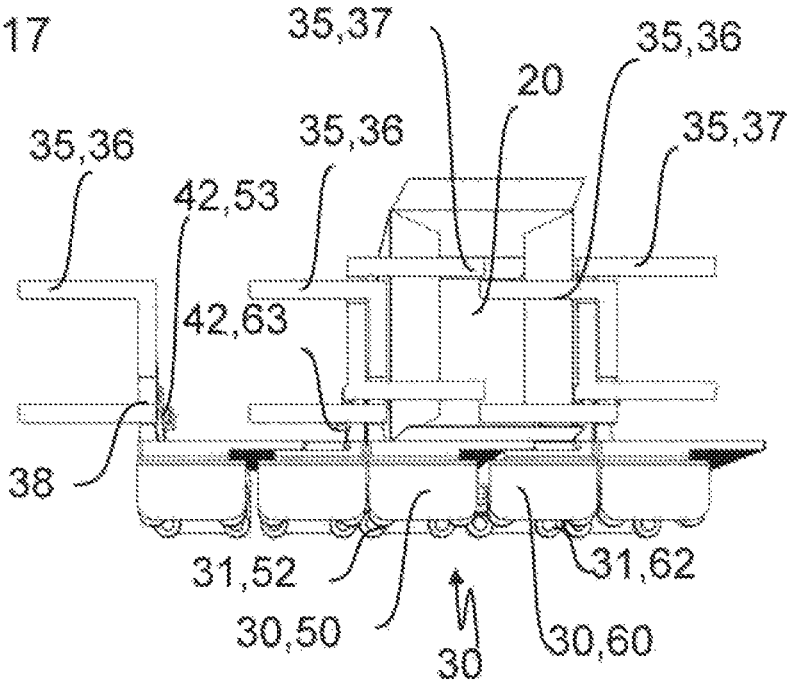
FIG. 17 shows a detail from FIG. 15.

A comparison of the FIGS. 12 and 16 or, as the case may be, of 13 and 17, makes the mode of operating or, as the case may be, the mode of acting, of the folding units 35, 36, 37 easily comprehensible. In a first operating state AZ1, the folding units 35, 36, 37 of a transporting and folding shuttle 30 are in each case disposed between said transporting and folding shuttle 30 and an adjacent transporting and folding shuttle 30 so that the folding units 35, 36, 37 do not act upon the side flaps 21 of the particular outer cardboard packages 20, 20-1. As is clearly discernible particularly in the FIGS. 7 to 9, the first folding units 36 of a first transporting and folding shuttle 30, 30-1 each have first guiding areas 38 for partially guiding and/or receiving the second folding units 37 of an adjacent transporting and folding shuttle 30, 30-2 that is, in particular, succeeding in the transport direction TR. Furthermore, the second folding units 37 of a first transporting and folding shuttle 30, 30-1 each have second guiding areas 39 for partially guiding and/or receiving the first folding units 36 of an adjacent transporting and folding shuttle 30, 30-3 that is, in particular, preceding in the transport direction TR.

Figure 11:
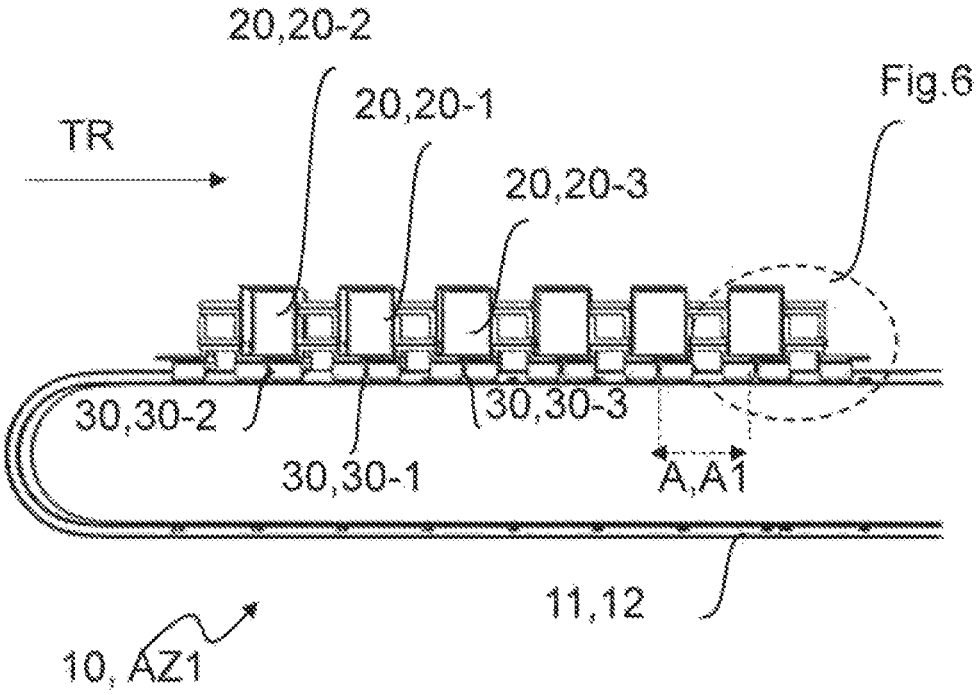
FIG. 11 shows a lateral illustration of a second embodiment of a folding device for closing carton side flaps according to FIG. 10 with outer cardboard packages.
Figure 15:
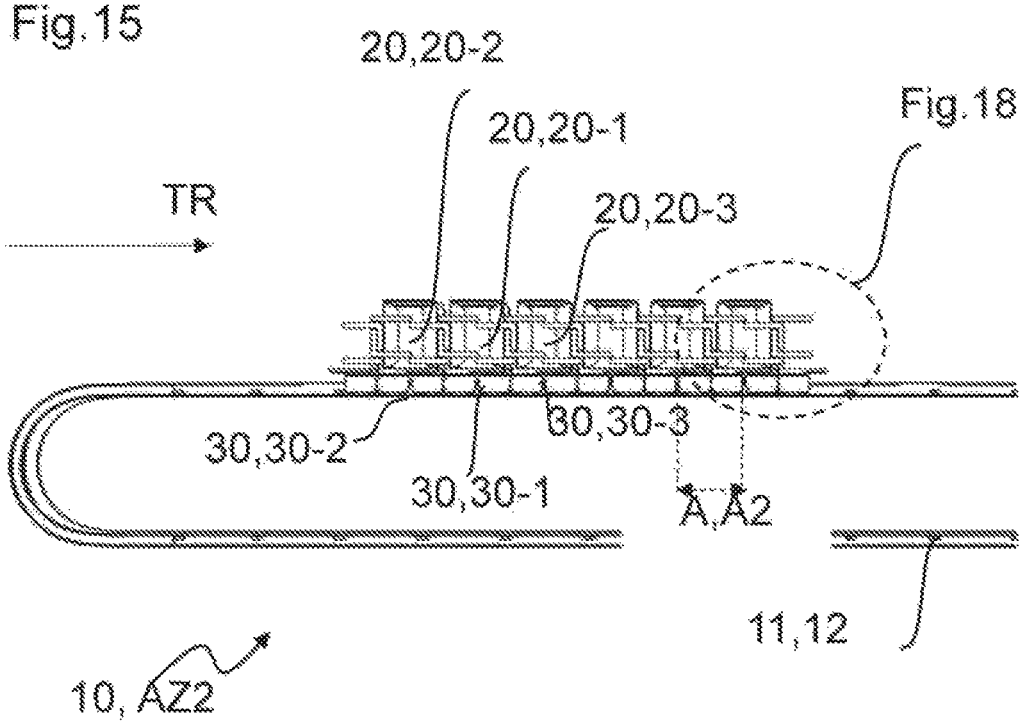
FIG. 15 shows a lateral illustration of a second embodiment of a folding device for closing carton side flaps according to FIG. 14 with outer cardboard packages.

By reducing the spacing A between the adjacent transporting and folding shuttles 30 from a spacing A1 in the first operating state AZ1 according to FIG. 11 to a smaller spacing A2 in the second operating state AZ2 according to FIG. 15, the first folding units 36 of the first transporting and folding shuttle 30, 30-1 are shifted relative to the second folding units 37 of the succeeding transporting and folding shuttle 30, 30-2 such that the first folding units 36 now engage with the open side flaps 21 of the outer cardboard package 20-2 disposed on the succeeding transporting and folding shuttle 30, 30-2, and fold in said side flaps 21 toward the body of the outer cardboard package 20-2. Furthermore, the second folding units 37 of the first transporting and folding shuttle 30, 30-1 are shifted relative to the first folding units 36 of the preceding transporting and folding shuttles 30, 30-3 such that the second folding units 37 now engage with the open side flaps 21 of the outer cardboard package 20-3 disposed on the preceding transporting and folding shuttle 30, 30-3, and fold in said side flaps 21 toward the body of the outer cardboard package 20-3. At the same time, the side flaps 21 of the first, middle outer cardboard package 20-2 are folded in by the first folding units 36 of the preceding transporting and folding shuttle 30, 30-3 and by the second folding units 37 of the succeeding transporting and folding shuttle 30, 30-2.

It can furthermore be provided that an extension unit (not illustrated) can be disposed between the partial areas 50 and 60 of the transporting and folding shuttle 30 in order to further increase the receiving or support area 34 for the outer cardboard packages 20, whereby the variability of the outer cardboard packages 20 to be handled is further increased. The extension unit is preferably likewise equipped with rolls for moving along the tracks 12 and comprises comb teeth intermeshing on one side between the first comb teeth 54 of the first partial area 50 and on the oppositely located side between the second comb teeth 64 of the second partial area 60 of the transporting and folding shuttle 30. The extension unit can be moved passively, in particular, by moving the partial areas 50, 60 between which it is disposed. It can, however, also be provided that the extension unit has its own drive such that it can also be driven in a speed-regulated and position-regulated manner.

Figure 18:
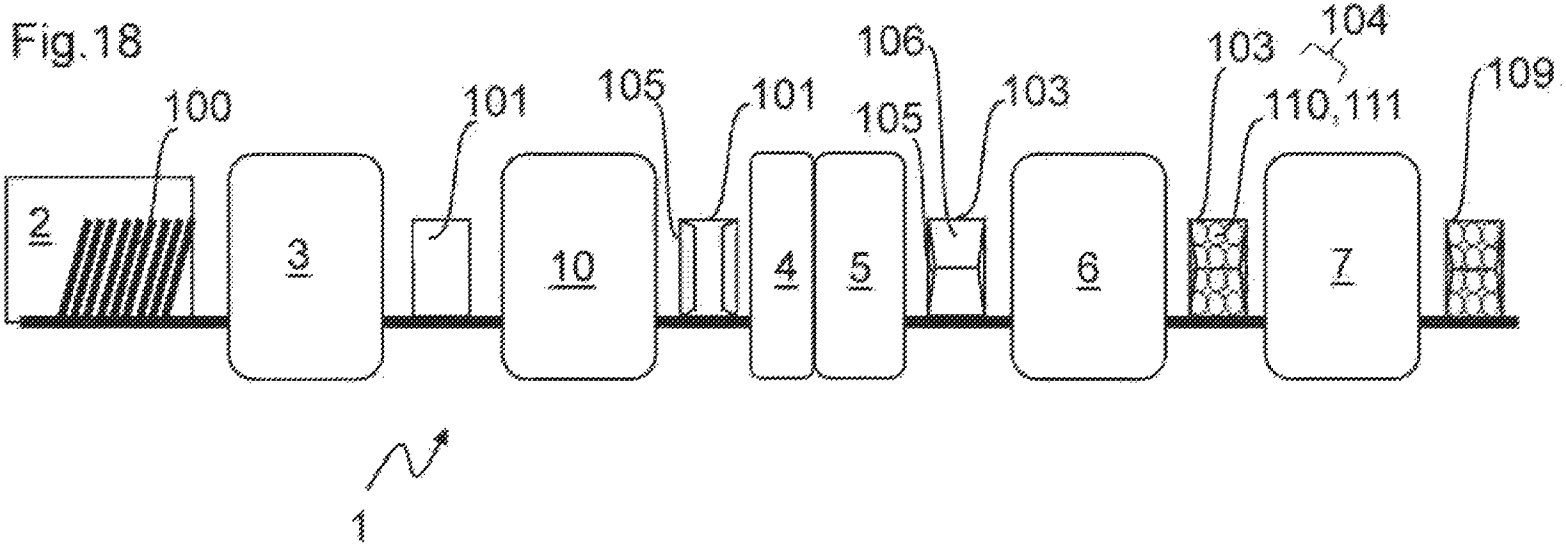
FIG. 18 schematically shows a first embodiment of a packaging facility with an embodiment of a folding device according to the invention.

In a schematic illustration, FIG. 18 shows a first embodiment of a packaging facility 1 with an embodiment of a folding device 10 according to the invention. If "RSC box blanks" 100 are exemplarily referred to in the context of the description of the FIGS. 18 and 19, this is to be understood to cover other outer packages in this connection as well, for example outer package blanks for baskets/bottle carriers, outer package blanks for multipacks, or outer package blanks for trays, outer package blanks for side-load cartons, outer package blanks for end-load cartons, outer package blanks for cartons with only one top flap and/or bottom flap, etc.

An already pre-glued RSC box blank 100 is taken from a magazine 2 and expanded in a first handling module 3 to form an expanded RSC box blank 101 which is open on two sides. The expanded RSC box blank 101 is then inserted into a transporting and folding shuttle 30 of a folding device 10 such that the openings are in each case arranged on a plane that is parallel to the transport direction TR of the transporting and folding shuttles 30. In the folding device 10, the inside flaps 105 of the expanded RSC box blank 101 are then folded in as has been described, for example, in connection with the FIGS. 1 and 2. In an adhesive application module 4, an adhesive, for example a glue or another suitable adhesive, is applied onto the outer sides of the inside flaps 105 that are folded in. In a second folding device 5 disposed downstream, the outside flaps 106 of the expanded RSC box blank 101 are now folded in such that the inner sides of the outside flaps 106 abut on the outer sides of the inside flaps 105 with the adhesive, and the outside flaps 106 are preferably adhesively connected to said inside flaps 105, thereby forming an RSC package 103 that is closed on one side. In a filling module 6, the articles 110, for example cans 111 or bottles, are then placed into the RSC package 103, which is closed on one side, by sliding them in from the side through the opening. The feeding of the articles 110 is carried out essentially perpendicular to the transport direction TR of the transporting and folding shuttle 30 within the folding device 5. In a further closing module 7, the flaps (not illustrated) at the side of the opening of the RSC package 103, which is closed on one side, are likewise folded in then, and a loaded RSC package 109 that is closed on both sides is formed. Again, an adhesive can be applied onto the outer side of the respective inside flap that are folded in in the folding device (not shown).

It can be provided in this connection that the RSC package 101 continues to remain and to be transported on the transporting and folding shuttles (reference character 30, cf. FIGS. 1 and 2) after the RSC package has been folded and the inside flaps 105 have been folded in, while the adhesive agent is being applied onto the outer sides of the inside flaps 105, the outside flaps 106 are folded in, and the RSC package 103 that is closed on one side is loaded from the side. The transporting and folding shuttles with the loaded RSC packages 104 closed on one side then move on to a further station, for example the closing module 7, where the still open side is closed. For this purpose it can be provided, for example, to transfer the loaded RSC packages 104 that are closed on one side onto transporting and folding shuttles that have folding units on the oppositely located side in analogy to the transporting and folding shuttles described above, such that the inside flaps of the opening are likewise folded in by a feeding movement of adjacent transporting and folding shuttles, with the folding units of a transporting and folding shuttle acting upon the inside flaps of a loaded RSC package 104 that is closed on one side and disposed on the adjacent transporting and folding shuttle.

Instead of two outside flaps 106 located opposite each other, it is also possible that only one larger outside flap is provided, which is folded over from below or from above onto the already folded-in inside flaps 105 such that a closed package can be formed. In order to realize this, the RSC package 103 that is closed on one side and loaded with articles 110 can, for example, be transferred onto transporting and folding shuttles 30 of a further folding device (not shown), which can have the appropriate folding units 35 such that closing the flaps as described above is carried out by a feeding movement of adjacent transporting and folding shuttles 30.

Figure 19:
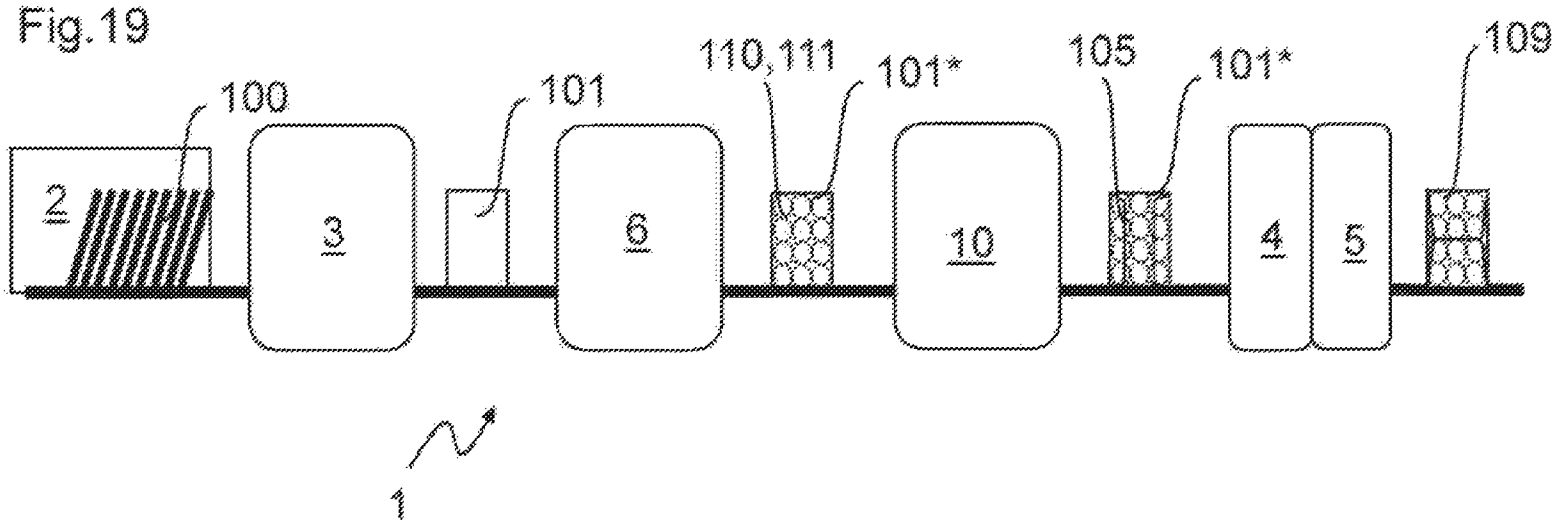
FIG. 19 schematically shows a second embodiment of a packaging facility with another embodiment of a folding device according to the invention.

FIG. 19 schematically shows a second embodiment of a packaging facility 1 with another embodiment of a folding device 10 according to the invention. In this packaging facility 1, too, an already pre-glued RSC box blank 100 is taken from a magazine 2 and expanded in a first handling module 3 to form an expanded RSC box blank 101.

In a filling module 6, the articles 110, for example cans 111 or bottles, are then placed into the expanded RSC box blank 101 by sliding them in from the side through the box openings and a loaded, expanded RSC box blank 101* is formed. In a folding device 10, the inside flaps 105 of the loaded, expanded RSC box blank 101* are then in each case folded in on both sides as has been described, for example, in connection with the FIGS. 1 and 2. In this instance, the particular transporting and folding shuttles 30 of the folding device 10 preferably each have folding units 35 on both sides parallel to the transport direction TR in order to be able to fold in the inside flaps 105 on both sides of the loaded, expanded RSC box blank 101* simultaneously.

In an adhesive application module 4, an adhesive is applied onto the particular outer sides of the inside flaps 105 that are folded in on both sides. In a second folding device 5 disposed downstream, the outside flaps 106 are now folded in on both sides so that the inner sides of the outside flaps 106 abut on the outer sides of the inside flaps 105 with the adhesive, and the outside flaps 106 are preferably adhesively connected to said inside flaps 105, thereby forming an RSC package 109 that is closed on both sides.

It is furthermore conceivable to design the folding units 35 on the transporting and folding shuttles 30 such that at least one top flap on a top side of an outer cardboard package 20 disposed on an adjacent transporting and folding shuttle 30 can be folded over or folded in, as the case may be. For this purpose, corresponding folding fingers have to be formed, for example, on a parallel plane above the conveying surface of the track system 11 and in each case leading away from the transporting and folding shuttle 30 toward the adjacent transporting and folding shuttle 30. In order to be able to use the folding device 10 for different box heights of outer cardboard packages 20 in a simple way, it is in this instance preferably provided to form a frame unit of the transporting and folding shuttle 30 on which the folding unit 35 is disposed to be variable in height. In this exemplary embodiment (not shown), for example, the top side of an outer cardboard package 20 can be closed by a feeding movement of adjacent transporting and folding shuttle 30 toward each other, with the outer cardboard package 20 being closed on the bottom side and disposed on a transporting and folding shuttle 30 of the folding device, the outer cardboard package 20 being, for example, an RSC cardboard package that has been filled with articles 110 by a top-load method.

The folding units 35 on the transporting and folding shuttles 30 can be designed to be variable and/or exchangeable (not shown) in order to be able to adapt the folding device 10 in a simple way to new requirements and/or to changed geometries of the outer cardboard packages 20 in the instance of a change of product. For example, the folding units 35 can be constructed to be length-variable parallel to the linear areas of the track system 11. A folding unit 35 can for example, be formed by at least two areas designed to be shiftable in relation to each other and disposed parallel to the linear area of the track system 11, where said two areas can be shifted relative to each other in order to correspondingly change the length of the folding unit 35. The folding units 35 can alternatively be designed to be telescoping. In particular for transporting and folding shuttles 30 that are designed in two parts with first and second partial areas 50, 60 being differently arrangeable relative to each other, where the transporting and folding shuttles 30 are suitable for transporting and processing different sizes of outer cardboard packages 20, it can be necessary to adapt the length of the folding units 35 according to the sizes of the outer cardboard packages 20 and sizes of the flaps 21.

Alternatively, the folding units 35 can be designed as exchangeable format parts that can be exchanged as required for a change of product in order to adapt the transporting and folding shuttles 30 in each case to the new product. Such a format change can optionally be carried out manually; the format change can also be carried out in an automated process, for example, by a robot or the like. Such a robot can preferentially be disposed in the deflection area T3 of the circulating track system 11. The robot can particularly be permanently disposed in this deflection area T3 without disturbing the production flow, since the feeding movement of the transporting and folding shuttles 30 toward each other for folding the flaps 21 of the outer cardboard packages 20 takes place particularly in the linear first transport section T1 of the track system 11.

The exchange of the folding units 35 is necessary, in particular, if a production change between top-load loading and side-load loading is to take place. A top-load loading is to be understood as placing the articles 110 from above into an outer cardboard package 20 that is open at the top. A side-load loading is to be understood as sliding the articles 110 from the side into an outer cardboard package 20 with an opening at the side. A further advantage of the folding device 10 described here thus lies therein that it can be used both for top-load loading and for side-load loading. Only a simple format change of the folding units 35 is necessary for this purpose, with the folding units 35, in particular, needing to be disposed differently on the transporting and folding shuttles 30 in order to be able to fold in the corresponding flaps 21.

A main advantage of the system lies therein that no large spacings are necessary between the sets of articles 110 to be packaged into a bundle and/or between the outer cardboard packages 20, to be transported and processed within the folding device 10 in order to fold in the side flaps 21 by suitable devices, because the folding units 35 of a transporting and folding shuttle 30 act upon the outer cardboard package 20 on a particular adjacent transporting and folding shuttle 30 by a reduction of the spacing A between the transporting and folding shuttles 30 within the track system 11. Only an initial spacing between the transporting and folding shuttles 30 is required to ensure that the at least one folding unit 35 of a transporting and folding shuttle 30 does not engage into the receiving or support area 34 of an outer cardboard package 20 of a directly adjacent transporting and folding shuttle 30. The folding device 10 can be particularly used for producing outer cardboard packages 20 with inside side flaps 105, such as so-called wraparound packages, for producing trays, or for loading already partly pre-folded outer cardboard packages 20 from the side. However, applications are also conceivable in which outside side flaps 106 are closed. In this instance, an adhesive application module 4 can additionally be associated with the folding device 10, which adhesive application module 4 applies appropriate adhesion points onto surfaces of the outer cardboard package 20 that are arranged parallel to the transport direction TR, where subsequently a contact between the adhesion point/s and the side flap/s 105, 106 folded over by the folding units 35 is formed and the side flap/s 105, 106 is/are thus secured in their position.

The embodiments, examples and alternatives of the preceding paragraphs, the claims, or the following figures and description, including any of their various aspects or respective individual features, may be taken independently or in any combination. Features described in connection with one embodiment are applicable to all embodiments, unless such features are incompatible.

The invention has been described with reference to a preferred embodiment. Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

LIST OF REFERENCE CHARACTERS

1 Packaging facility
2 Magazine
3 Handling module
4 Adhesive application module
5 Second folding device
6 Filling module
7 Closing module
10 Folding device
11 Track system
12 Track
20, 20-1, 20-2, 20-3 Outer cardboard package
21 Carton side flap, side flap
30, 30-1, 30-2, 30-3 Transporting and folding shuttle
31 Roll, roller system
32 Drive
33 Linear motor
34 receiving or support area
35 Folding unit
36 First folding unit
37 Second folding unit
38 First guiding area
39 Second guiding area
40 Control device
42 Holding unit
50 First partial area
51 First comb-shaped receiving or support area
52 Roll
53 First holding unit
54 First comb teeth
60 Second partial area
61 Second comb-shaped receiving or support area

62 Roll
63 Second holding unit
64 Second comb teeth
100 RSC box blank
101 Expanded RSC box blank
101* Loaded, expanded RSC box blank
103 RSC package closed on one side
104 Loaded RSC package closed on one side
105 Inside flap
106 Outside flap
109 RSC package closed on both sides
110 article
111 can
A, A1, A2 Spacing
AZ1 First operating state
AZ2 Second operating state
B20, B30 Width
d Spacing
T1 First transport section
T2 Second transport section
T3 Deflection area
TR Transport direction

The invention claimed is:

1. A folding device (10) for transporting an outer cardboard package (20) having folding lines and for folding at least one side flap (21) of the outer cardboard package (20), the folding device (10) comprising:

at least one conveyor system with a guiding unit (11) and with at least two transporting and folding shuttles (30) disposed on the guiding unit (11) for the transport of an outer cardboard packages (20) in a transport direction (TR);

wherein the at least two shuttles (30) are disposed in a row in the transport direction (TR) in the conveyor system and are transportable in the transport direction (TR) by the conveyor system; and wherein each shuttle (30) has at least one folding unit (35) for folding over at least one side flap (21) of the outer cardboard package (20), wherein the at least one folding unit (35) extends away from a receiving area (34) for the outer cardboard package (20) and toward an adjacent one of the at least two shuttles (30) and wherein the at least one folding unit (35) is a stop for the outer cardboard package (20) disposed on the adjacent shuttle (30).

2. The folding device (10) as recited in claim 1, wherein the at least one folding unit (35) extends parallel to the transport direction (TR) of the conveyor system.

3. The folding device (10) as recited in claim 1, wherein the conveyor system comprises a track system with at least two parallely guided tracks (12), and wherein the at least two shuttles (30) have rolls (31) being guided on the tracks (12).

4. The folding device (10) as recited in claim 1, wherein the conveyor system comprises a part of a linear motor arrangement, wherein each of at the least two shuttles (30) comprises a part of a linear motor arrangement, and wherein the folding device further comprises a control device (40) for the linear motor arrangement, and wherein each of the at least two shuttles (30) is individually controllable.

5. The folding device (10) as recited in claim 1, wherein the at least two shuttles (30) each consist of two partial areas (50, 60), wherein the partial areas (50, 60) are disposed one after another in the transport direction (TR).

6. The folding device (10) as recited in claim 5, wherein each partial area (50, 60) forms a partial receiving area (51, 61) of each of the at least two shuttles (30) for the outer cardboard package (20) and wherein the partial receiving areas (51, 61) each have a comb structure with comb teeth (54, 64), wherein the comb teeth (54, 64) of the two partial areas (50, 60) are disposed to at least partly engage with each other.

7. The folding device (10) as recited in claim 6, wherein the one partial area (50) has first holding units (53) and the other partial area (60) has second holding units (63) for the outer cardboard package, and wherein the partial areas (50, 60) are shiftable in relation to each other, whereby a spacing (d) between the first holding units (53) and the second holding units (63) is adjustable.

8. The folding device (10) as recited in claim 5, wherein at least one of the partial areas (50, 60) comprises at least one folding unit (35), and wherein each of the partial areas (50, 60) comprises in each case at least one folding unit (35), wherein the at least one folding unit (35) extends away from the particular other partial area (50, 60) of the shuttle (30), parallel to the transport direction (TR) of the conveyor system.

9. A packaging facility for articles, comprising:

a grouping module for assembling a plurality of articles to an article group to be packaged; and an outer packaging module for producing an outer package, wherein the outer packaging module comprises a folding device (10) for transporting and folding at least one side flap (21) of the outer cardboard package (20) having folding lines, the folding device (10) comprising:

at least one conveyor system with a guiding unit (11) and with at least two transporting and folding shuttles (30) disposed on the guiding unit (11) for the transport of an outer cardboard package (20) in a transport direction (TR);

wherein the at least two shuttles (30) are disposed in a row in the transport direction (TR) in the conveyor system and are transportable in the transport direction (TR) by the conveyor system;

wherein each shuttle (30) has at least one folding unit (35) for folding over at least one side flap (21) of the outer cardboard package (20), wherein the at least one folding unit (35) extends away from a receiving area (34) for the outer cardboard package (20) and toward an adjacent one of the at least two shuttles (30) and wherein the at least one folding unit (35) is a stop for the outer cardboard package (20) disposed on the adjacent shuttle (30).

10. The packaging facility as recited in claim 9, wherein the at least one folding unit (35) extends parallel to the transport direction (TR) of the conveyor system.

11. The packaging facility as recited in claim 9, wherein the conveyor system comprises a track system with at least two parallely guided tracks (12), and wherein the at least two shuttles (30) have rolls (31) being guided on the tracks (12).

12. A method for folding at least one side flap (21) of an outer cardboard package (20) having folding lines, comprising:

disposing a first outer cardboard package (20) on a first transporting unit and folding shuttle (30-1) of a conveyor system, disposing the first shuttle (30-1) within the conveyor system to precede a second transporting and folding shuttle (30-2) and/or to succeed a third transporting and folding shuttle (30-3) at a first spacing (A1), and folding over at least one side flap (21) of the first outer cardboard package (20) by at least one folding unit (35) associated with the second shuttle (30-2) and/or with the third shuttle (30-3) by changing the first spacing (A1) between the first shuttle (30-1) and the second shuttle (30-2) and/or the third shuttle (30-3) to a second spacing (A2).

13. The method as recited in claim 12, wherein the changing of the first spacing (A1) to the second spacing (A2) between the first shuttle (30-1) and the second shuttle (30-2) and/or the third shuttle (30-3) is carried out by changing a transport speed of at least one of the first, second, or third shuttles (30-1, 30-2, 30-3).

14. The method as recited in claim 13, further comprising using a control device (40) to control changing of the transport speed of at least one of the first, second, or third shuttles (30-1, 30-2, 30-3).

15. The method as recited in claim 14, wherein each of the first, second, or third shuttles (30-1, 30-2, 30-3) have a first transport speed and the method further comprising increasing a transport speed of the second shuttle (30-2) relative to the first transport speed of the first shuttle (30-1) and/or increasing a transport speed of the first shuttle (30-1) relative to the first transport speed of the third shuttle (304-3).

16. The method as recited in claim 13, wherein each of the first, second, or third shuttles (30-1, 30-2, 30-3) are moved at a first transport speed the method further comprising increasing a transport speed of the second shuttle (30-2) relative to the first transport speed of the first shuttle (30-1) and/or increasing a transport speed of the first shuttle (30-1) relative to the first transport speed of the third shuttle (30-1).

* * * * *